US010753706B2

(12) United States Patent
Stolov

(10) Patent No.: US 10,753,706 B2
(45) Date of Patent: Aug. 25, 2020

(54) OPTICAL AIMING DEVICE

(71) Applicant: Evgeny Stolov, Jerusalem (IL)

(72) Inventor: Evgeny Stolov, Jerusalem (IL)

( * ) Notice: Subject to any disclaimer, the term of this patent is extended or adjusted under 35 U.S.C. 154(b) by 334 days.

(21) Appl. No.: 15/736,405

(22) PCT Filed: Jun. 30, 2016

(86) PCT No.: PCT/IL2016/050707
§ 371 (c)(1),
(2) Date: Dec. 14, 2017

(87) PCT Pub. No.: WO2017/002124
PCT Pub. Date: Jan. 5, 2017

(65) Prior Publication Data

US 2018/0149448 A1 May 31, 2018

(30) Foreign Application Priority Data

Jul. 2, 2015 (IL) ..... 239758

(51) Int. Cl.
*F41G 1/00* (2006.01)
*F41G 1/30* (2006.01)
(Continued)

(52) U.S. Cl.
CPC ..... *F41G 1/30* (2013.01); *F41G 1/345* (2013.01); *F41G 1/40* (2013.01)

(58) Field of Classification Search
CPC ..... F41G 1/30; F41G 1/40; F41G 1/345
(Continued)

(56) References Cited

U.S. PATENT DOCUMENTS 3,511,556 A 5/1970 Ammann
4,806,007 A 2/1989 Bindon
(Continued)

FOREIGN PATENT DOCUMENTS

FR 925107 8/1947
GB 1002999 9/1965
(Continued)

OTHER PUBLICATIONS

An International Search Report and a Written Opinion both dated Oct. 24, 2016, which issued during the prosecution of Applicant's PCT/IL2016/050707.
(Continued)

*Primary Examiner* — Mark Hellner
(74) *Attorney, Agent, or Firm* — Sughrue Mion, PLLC

(57) ABSTRACT

An optical aiming device including a first multi-faceted optical element lying on an axis and a second multi-faceted optical element juxtaposed to the first multi-faceted optical element and angled with respect thereto, the first and second optical elements each being characterized by a refractive index and a critical angle defining at least one total internal reflection plane formed by at least one facet of each one of the first and second optical elements, the at least one facet having an optical interference coating formed thereon, each one of the first and second optical elements causing light impinging on the at least one total internal reflection plane at an angle greater than or equal to the critical angle to be totally reflected and light impinging on the at least one total internal reflection plane at an angle less than the critical angle to be partially reflected and partially refracted, the totally reflected light illuminating a first region, the partially reflected light partially illuminating a second region, a demarcation being defined between the first and second regions, the first and second optical elements being oriented
(Continued)

such that the demarcations of the first and second optical elements intersect at a point lying substantially along the axis.

19 Claims, 32 Drawing Sheets

(51) Int. Cl.
*F41G 1/40* (2006.01)
*F41G 1/34* (2006.01)

(58) Field of Classification Search
USPC ..... 359/333
See application file for complete search history.

(56) References Cited

U.S. PATENT DOCUMENTS

| | | | |
|---|---|---|---|
| 5,002,364 | A | 3/1991 | Steenblik |
| 5,151,800 | A | 9/1992 | Upatnieks |
| 5,369,888 | A | 12/1994 | Kay et al. |
| 5,383,278 | A | 1/1995 | Kay |
| 5,440,424 | A | 8/1995 | Wu et al. |
| 5,579,159 | A | 11/1996 | Ito |
| 5,937,557 | A | 8/1999 | Bowker et al. |
| 5,953,165 | A | 9/1999 | Stolov |
| 2002/0041440 | A1 | 4/2002 | Cross |
| 2004/0076928 | A1 | 4/2004 | Renntoft |
| 2009/0265974 | A1 | 10/2009 | Joannes |
| 2014/0036356 | A1 | 2/2014 | Feinbloom et al. |
| 2014/0041277 | A1* | 2/2014 | Hamilton ..... F41G 1/345 42/122 |
| 2015/0168102 | A1* | 6/2015 | Jeung ..... F41G 1/30 42/130 |

FOREIGN PATENT DOCUMENTS

| | | |
|---|---|---|
| WO | 97/02462 | 1/1997 |
| WO | 2017/002124 | 1/2017 |

OTHER PUBLICATIONS

An International Preliminary Report on Patentability dated Jan. 2, 2018, which issued during the prosecution of Applicant's PCT/IL2016/050707.

* cited by examiner

OPTICAL AIMING DEVICE

CROSS REFERENCE TO RELATED APPLICATIONS

This application is a National Stage of International Application No. PCT/IL2016/050707 filed Jun. 30, 2016, claiming priority based on Israel Patent Application No. 239758, entitled IMPROVED OPTICAL AIMING DEVICE, filed Jul. 2, 2015, the disclosure of which is hereby incorporated by reference and priority of which is hereby claimed pursuant to 37 CER 1.78(a)(4) and (5)(i).

FIELD OF THE INVENTION

The present invention relates generally to optical devices and more particularly to optical devices for the aiming of light.

BACKGROUND OF THE INVENTION

Various types of optical devices are known in the art.

SUMMARY OF THE INVENTION

The present invention seeks to provide an improved, compact optical device for the aiming and directing of light.

There is thus provided in accordance with a preferred embodiment of the present invention an optical aiming device including a first multi-faceted optical element lying on an axis and a second multi-faceted optical element juxtaposed to the first multi-faceted optical element and angled with respect thereto, the first and second optical elements each being characterized by a refractive index and a critical angle defining at least one total internal reflection plane formed by at least one facet of each one of the first and second optical elements, the at least one facet having an optical interference coating formed thereon, each one of the first and second optical elements causing light impinging on the at least one total internal reflection plane at an angle greater than or equal to the critical angle to be totally reflected and light impinging on the at least one total internal reflection plane at an angle less than the critical angle to be partially reflected and partially refracted, the totally reflected light illuminating a first region, the partially reflected light partially illuminating a second region, a demarcation being defined between the first and second regions, the first and second optical elements being oriented such that the demarcations of the first and second optical elements intersect at a point lying substantially along the axis.

Preferably, the first and second optical elements are separated from each other by a gap including a material having substantially the same refractive index as the refractive index of the first and second optical elements.

Preferably, each one of the first and second optical elements includes a prism.

Preferably, each one of the first and second optical elements includes only a single one of the prism.

Preferably, the prisms are optically identical and are positioned such that perpendiculars to the total internal reflection planes thereof are not mutually parallel.

In accordance with a preferred embodiment of the present invention, each the prism includes a prism-parallelogram including an entry facet for light entering the prism-parallelogram, an exit facet generally parallel to the entry facet for light exiting the prism-parallelogram and two mutually generally parallel facets respectively forming two the total internal reflections planes.

In accordance with another preferred embodiment of the present invention, the optical aiming device also includes first and second wedge prisms respectively juxtaposed to the entry and exit facets of the prism-parallelogram, the first and second wedge prisms having optical dispersion characteristics differing from an optical dispersion characteristic of the prism-parallelogram.

Additionally or alternatively, the optical aiming device includes a spacer layer formed on each the optical interference coating and a mirror formed on each the spacer layer, the spacer layer defining a space between the optical interference coating and the mirror.

In accordance with a further preferred embodiment of the present invention, each prism includes a triangular prism and each one of the first and second optical elements also includes a mirror associated with each the triangular prism.

Preferably, each triangular prism includes an entry facet for light entering the triangular prism, an exit facet for light exiting the triangular prism and a facet forming one the total internal reflection plane In accordance with yet a further preferred embodiment of the present invention, the optical aiming device also includes first and second wedge prisms respectively juxtaposed to the entry and exit facets of the triangular prism, the first and second wedge prisms having optical dispersion characteristics differing from an optical dispersion characteristic of the triangular prism.

Additionally or alternatively, the optical aiming device includes a spacer layer formed on each the optical interference coating and a mirror formed on each the spacer layer, the spacer layer defining a space between the optical interference coating and the mirror.

Preferably, the mirror is a folding mirror rotatable about one axis thereof, such that the folding mirror may be held in an extended position when the optical aiming device is in use and may be held in a folded position when the optical aiming device is not in use.

Preferably, the folding mirror has two mutually orthogonal axes of rotation.

Preferably, the optical interference coating includes alternating layers of ZnS and $MgF_2$.

Alternatively, the optical interference coating includes alternating layers of $HfO_2$ and $SiO_2$.

In accordance with a preferred embodiment of the present invention, the optical aiming device also includes a generally linear narrow angle light source located in front of one of the optical elements.

Additionally or alternatively, the optical aiming device also includes a removable optical magnification system.

There is also provided in accordance with a preferred embodiment of the present invention an optical aiming system including two co-aligned abutting optical aiming devices of the present invention.

There is further provided in accordance with another preferred embodiment of the present invention a laser system including an optical resonator, an active laser medium located within the optical resonator for outputting optically amplified light and an optical aiming device in accordance with a preferred embodiment of the present invention, for receiving the optically amplified light and suppressing a portion thereof.

There is additionally provided in accordance with yet another preferred embodiment of the present invention a cosmetology device including a light source for outputting light, a focusing system for receiving and focusing the light from the light source and an optical aiming device in accordance with a preferred embodiment of the present invention for receiving the light from the focusing system and forming a spot of the light.

There is still further provided in accordance with yet a further preferred embodiment of the present invention a method for aiming a weapon at a target including providing two optical elements mounted on the weapon, each one of the two optical elements being characterized by a refractive index and a critical angle defining at least one total internal reflection plane thereof, one of the two optical elements lying on an aiming axis of the weapon, each optical element causing light impinging on the at least one total internal reflection plane at an angle greater than or equal to the critical angle to be totally reflected and light impinging on the at least one total internal reflection plane at an angle less than the critical angle to be partially reflected and partially refracted, the totally reflected light illuminating a first region, the partially reflected light partially illuminating a second region, a demarcation being defined between the first and second regions, the optical elements being oriented such that the demarcations of the optical elements intersect at a point lying substantially along the aiming axis and aligning the intersection point with the target.

Preferably, the light impinging on the at least one total internal reflection plane is achromatic.

Additionally or alternatively, the light impinging on the at least one total internal reflection plane is at least partially chromatic.

Preferably, the partially refracted light is partially trapped by the optical element when the angle is less than but close to the critical angle.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
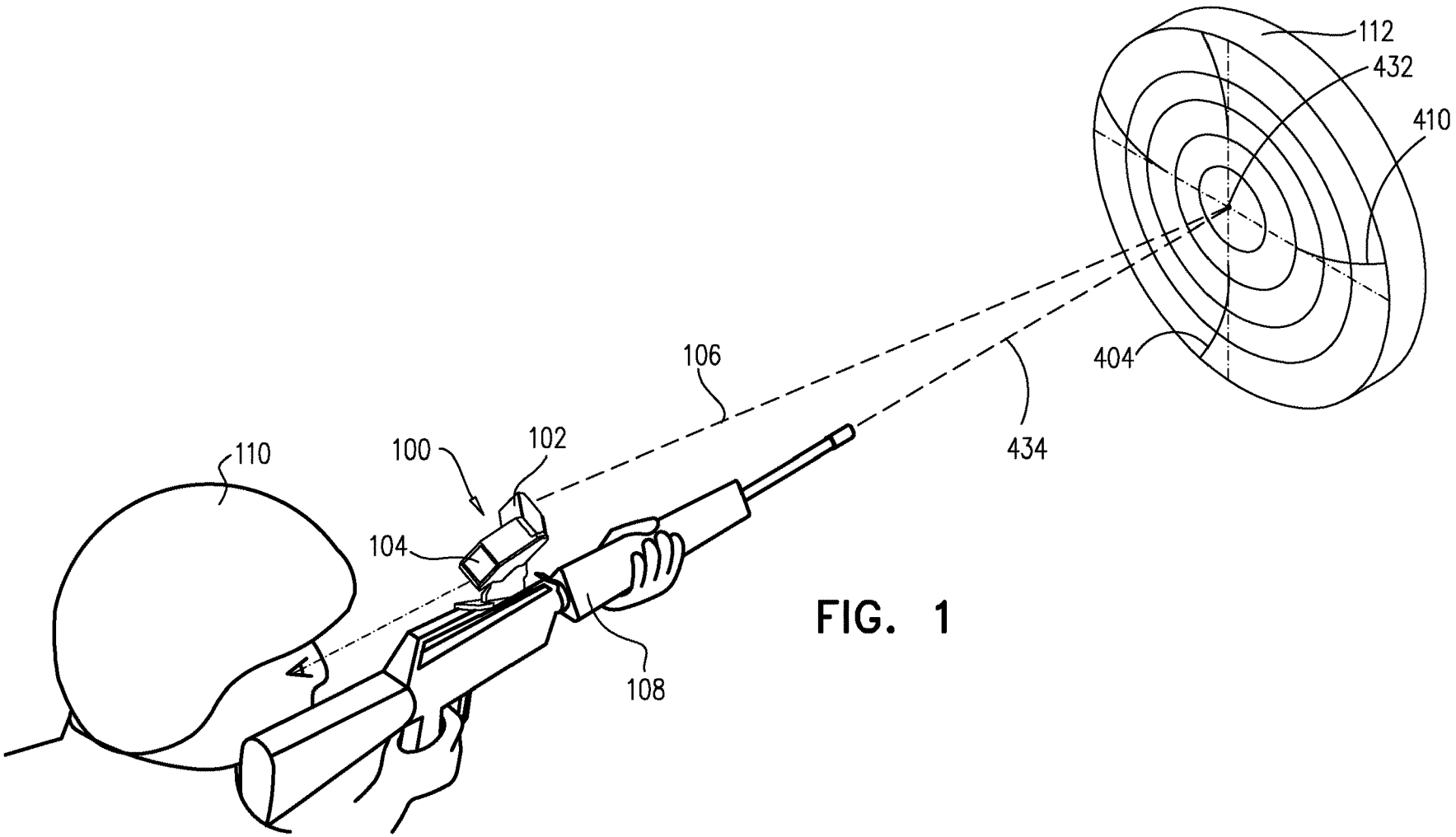
FIG. 1 is a simplified pictorial illustration of an optical aiming device constructed and operative in accordance with a preferred embodiment of the present invention.
Figure 2:
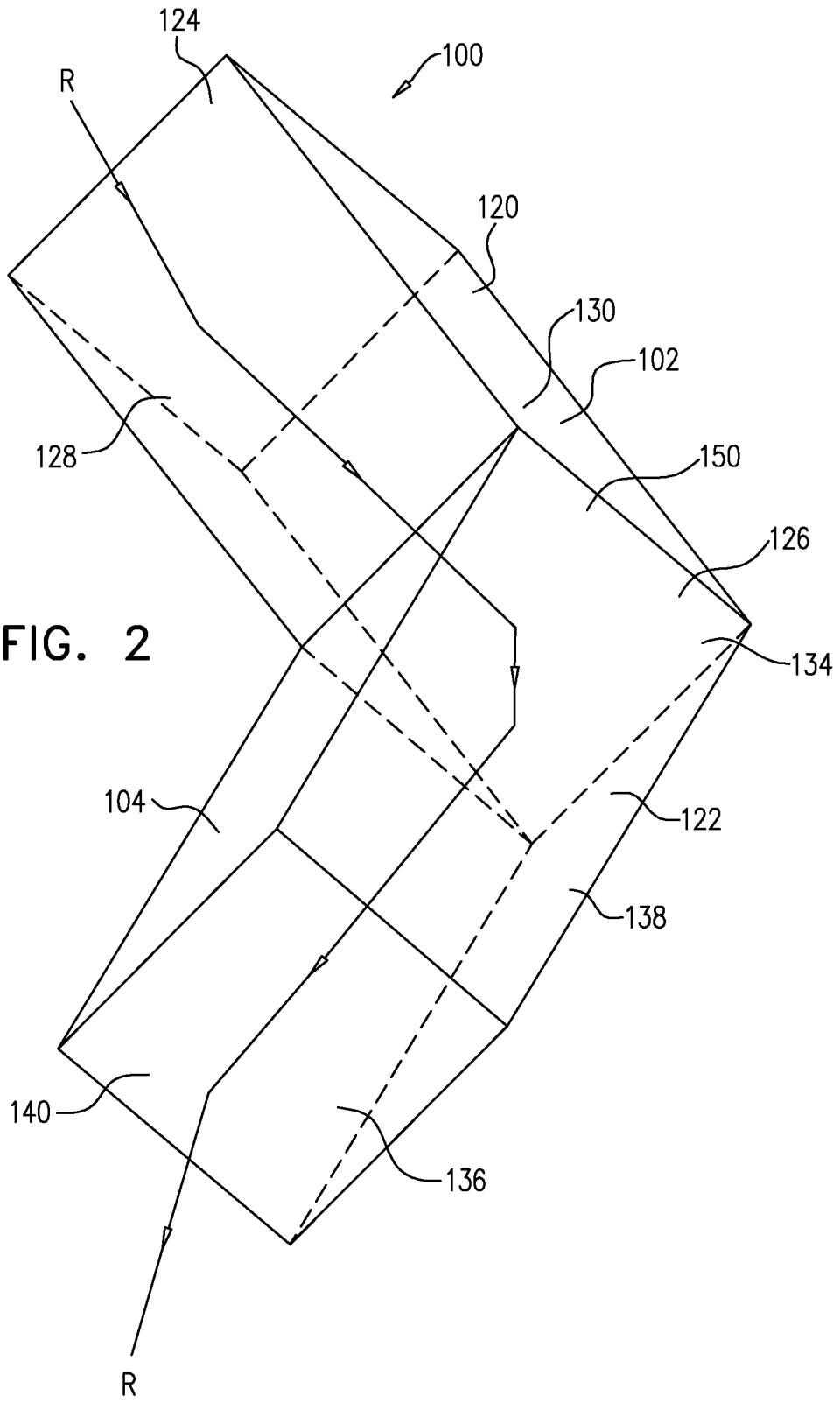
FIG. 2 is a simplified expanded perspective view illustration of an optical aiming device of the type illustrated in FIG. 1.

Reference is now made to FIG. 1, which is a simplified pictorial illustration of an optical aiming device constructed and operative in accordance with a preferred embodiment of the present invention and to FIG. 2, which is a simplified expanded perspective view illustration thereof.

As seen in FIG. 1, there is provided an optical device 100 including a first optical element 102 and a second optical element 104 juxtaposed to the first optical element 102 and angled with respect thereto. Optical device 100 is preferably operative to optically aim light and hence is termed henceforth an optical aiming device 100. It is appreciated that optical aiming device 100 may be employed in a variety of applications in which the aiming of light is required, including military, optical and medical applications, as will be detailed henceforth.

First optical element 102 preferably lies on an axis 106 which axis 106 is an aiming axis. Optical aiming device 100 may be mounted on a weapon, here shown, by way of example, to be a gun 108, such that a user 110 sights through optical aiming device 100 in the direction of a target 112 and visible light emanating from target 112 impinges on optical aiming device 100. Optical aiming device 100 and correspondingly axis 106 may be oriented at any angle with respect to target 112 provided that light emanating from target 112 enters optical aiming device 100. Optical aiming device 100 is preferably adapted to aid user 110 to aim weapon 108 at target 112, in a manner to be detailed henceforth.

As seen most clearly in FIG. 2, each one of first and second optical elements 102 and 104 preferably comprises a multi-faceted optical element, here embodied, by way of example, as respective first and second prism-parallelograms 120 and 122. It is appreciated, however, that first and second optical elements 102 and 104 are not limited to being formed as prism-parallelograms and may be embodied as a variety of other shaped multi-faceted optical elements, including triangular prisms, as will be exemplified henceforth.

First prism 120 comprising first optical element 102 preferably includes a first entry facet 124, though which light emanating from target 112 may enter first optical element 102 and a generally parallel opposite first exit facet 126, through which light having propagated through prism 120 may exit first optical element 102. First prism 120 is characterized by a refractive index and a critical angle, these defining at least one total internal reflection plane formed by at least one facet thereof. Here, by way of example, two total internal reflection planes of first prism 120 are respectively formed by a first reflective facet 128 and a second generally parallel reflective facet 130, at which first and second reflective facets 128 and 130 total internal reflection may occur.

First and second prism-parallelograms 120 and 122 respectively forming first and second optical elements 102 and 104 may be mutually optically identical. Thus, second prism 122 of second optical element 104 preferably includes a second entry facet 134, though which light emerging from first optical element 102 may enter second optical element 104 and a generally parallel second opposite exit facet 136, through which light having propagated through prism 122 may exit second optical element 104. Second prism 122 is characterized by a refractive index and a critical angle defining at least one total internal reflection plane formed by at least one facet thereof, which refractive index and critical angle are preferably the same as the refractive index and critical angle associated with first prism 120. Here, by way of example, two total internal reflection planes of second prism 122 are formed by a third reflective facet 138 and a fourth generally parallel reflective facet 140, at which third and fourth reflective facets 138 and 140 total internal reflection may occur.

Figure 3:
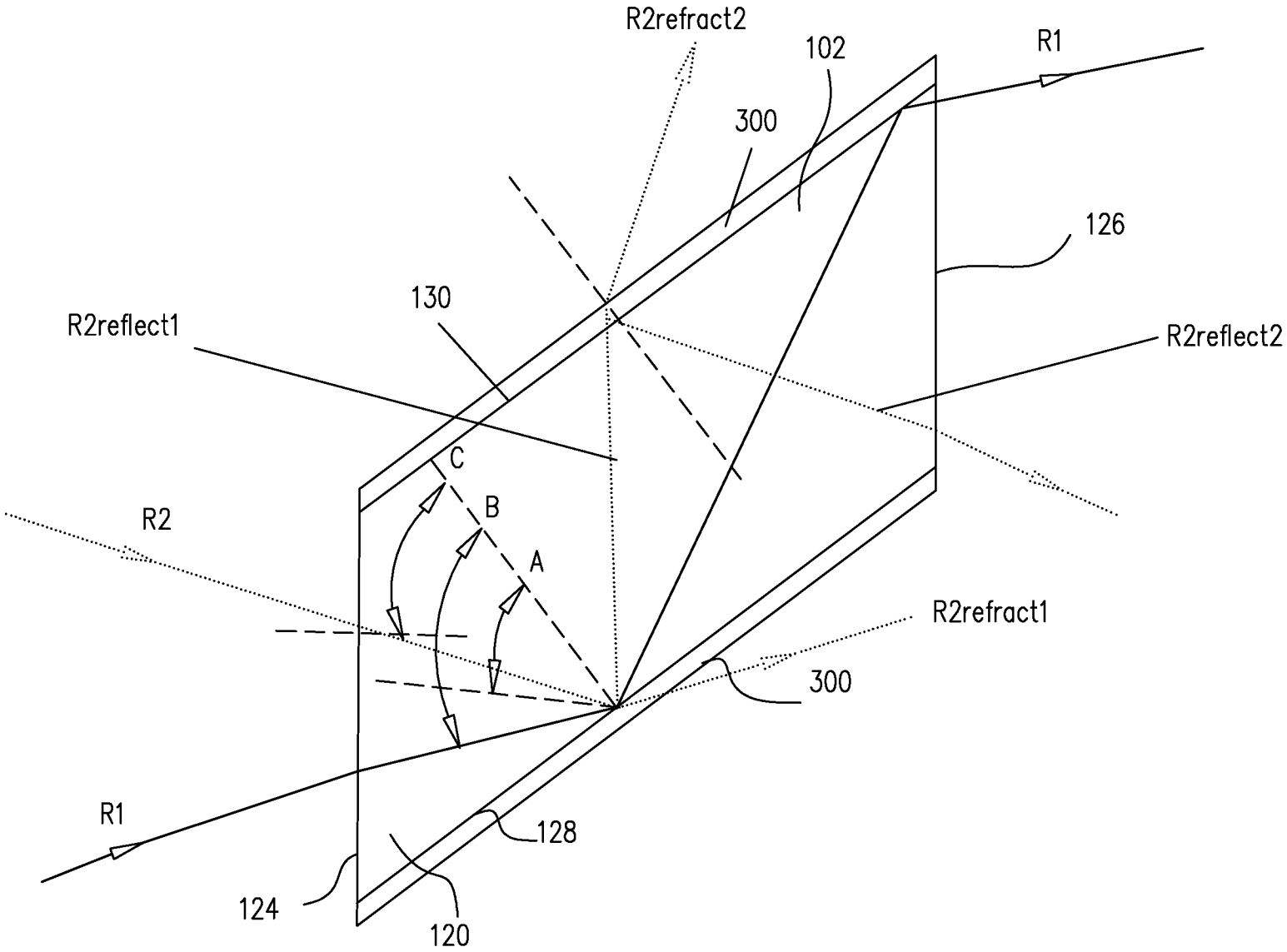
FIG. 3 is a simplified side view illustration of an optical element of an optical aiming device of the type illustrated in FIGS. 1 and 2, depicting light impinging thereon.
Figure 5A:
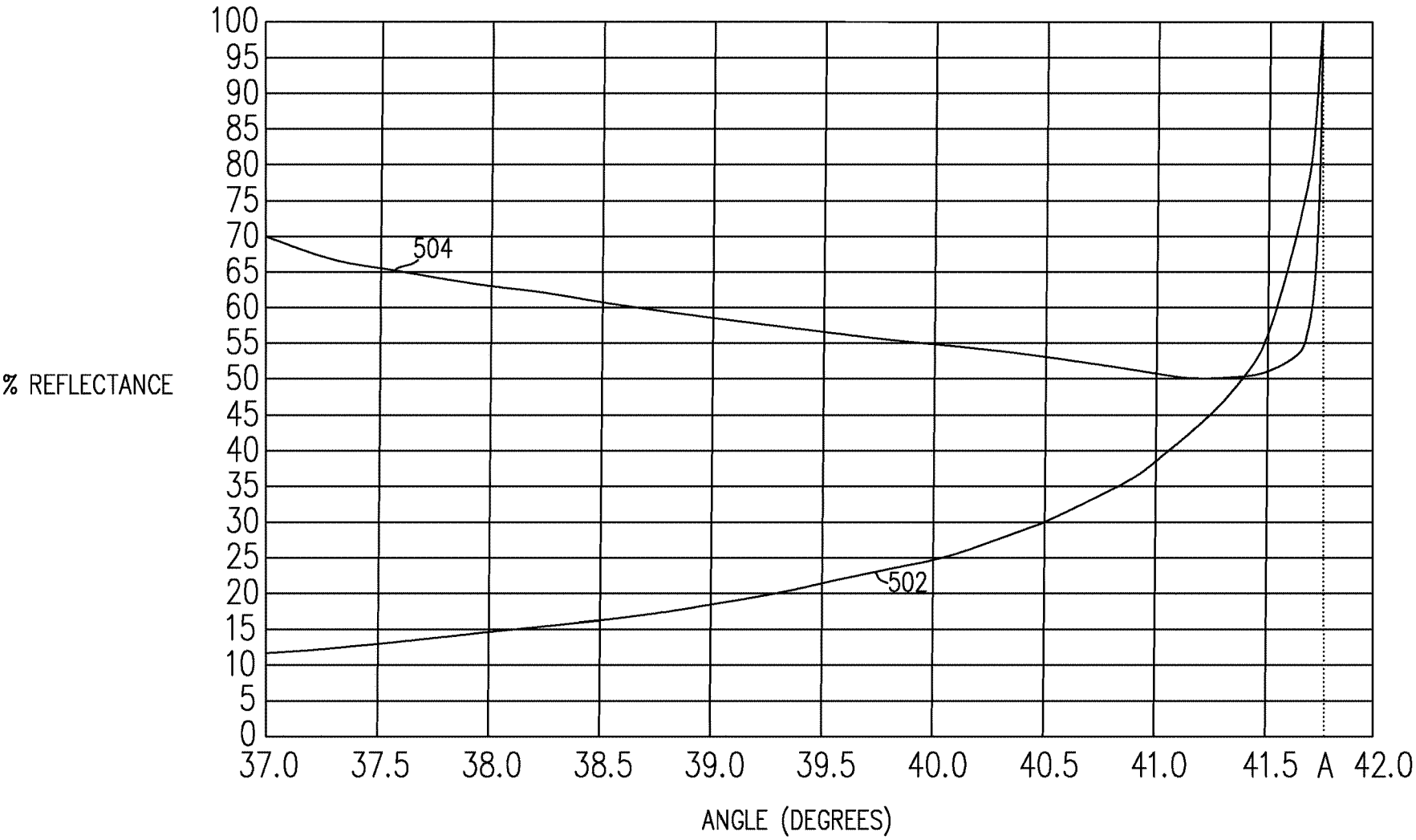
FIGS. 5A and 5B are simplified respective graphs of overall reflection coefficients and S and P component reflection coefficients of light reflected from an optical aiming device of the type illustrated in FIG. 1.
Figure 5B:
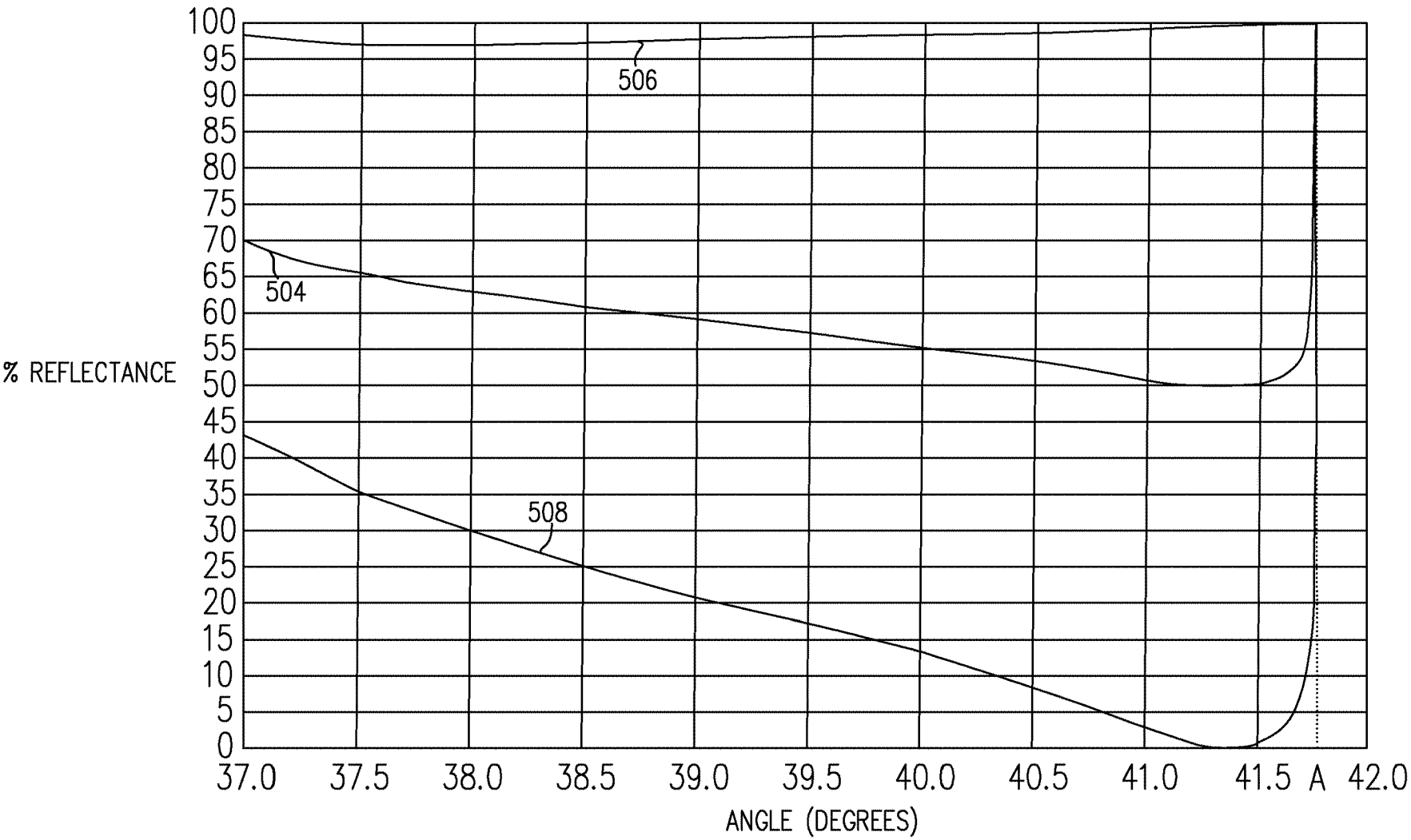

A multi-layer interference optical coating (not shown in FIG. 2) may be formed on each one of first, second, third and fourth reflective facets 128, 130, 138, 140 in order to modify the reflective properties thereof and thereby improve the field of view provided to user 110 of optical aiming device 100, in a manner to be detailed henceforth with reference to FIGS. 3, 5A and 5B. The multi-layer interference optical coatings formed on each one of first, second, third and fourth reflective facets 128, 130, 138, 140 are preferably mutually identical, although it is envisioned that the multi-layer interference optical coatings formed on the four reflective facets may alternatively be mutually different.

As seen in FIGS. 1 and 2, the two optical elements 102 and 104 are preferably oriented such that perpendiculars to the first and second reflective facets 128 and 130 of first prism 120 are angled with respect to perpendiculars to the third and fourth reflective facets 138 and 140 of second prism 122. The angle between the perpendiculars is preferably about 90°±15°.

First and second optical elements 102 and 104 are preferably separated by a gap, here shown, by way of example, to be embodied as a gap 150 formed between mutually juxtaposed first exit facet 126 of first prism 120 and second entry facet 134 of second prism 122. Gap 150 preferably comprises a material having a refractive index equal or substantially similar to that of first and second prisms 120 and 122.

As appreciated from consideration of the path of a typical light beam R shown propagating through optical aiming device 100 in FIG. 2, first entry facet 124 of first prism 120 preferably forms an entry facet of optical aiming device 100 with respect to light emanating from target 112 and second exit facet 136 of second prism 122 preferably forms an exit facet of optical aiming device 100 with respect to light propagating towards user 110.

Reference is now made to FIG. 3, which is a simplified side view illustration of an optical element of an optical aiming device of the type illustrated in FIGS. 1 and 2, depicting light impinging thereon. It is appreciated that for the sake of simplicity and clarity, only one prism-parallelogram, such as prism 120, of optical element 102 is depicted in FIG. 3 and the corresponding description hereinbelow relates to the passage of light therethrough. It is understood, however, that the explanation provided hereinbelow also applies to second prism-parallelogram 122 of optical element 104. It is further appreciated that for the sake of ease of presentation, prism-parallelogram 120 is shown oriented 180° with respect to the orientation thereof shown in FIG. 2.

As seen in FIG. 3, a first typical ray of light R1 emanating from target 112 enters first prism 120 via first entry facet 124. First prism 120 is characterized by a refractive index and a critical angle A, defining first and second total internal reflection planes 128 and 130, each of which total internal reflection planes 128 and 130 preferably has a multi-layer optical interference coating 300 disposed thereon, as described above with reference to FIG. 2.

First ray of light R1 impinges on first total internal reflection plane 128 at an angle equal to or greater than critical angle A, such as at an angle B, and therefore undergoes total internal reflection at first total internal reflection plane 128, in a direction towards second total internal reflection plane 130. The reflected ray R1 then again undergoes total internal reflection upon impinging on second total internal reflection plane 130 at angle B greater than critical angle A, and subsequently leaves first prism 120 via first exit facet 126.

A second typical ray of light R2 emanating from target 112 enters first prism 120 via first entry facet 124 and impinges on first total internal reflection plane 128 at angle less than critical angle A, such as at an angle C. One portion $R2_{reflect1}$ of second ray of light R2 is partially reflected from first total internal reflection plane 128 and another portion $R2_{refract1}$ is partially refracted through total internal reflection plane 128. The reflected portion $R2_{reflect1}$ then again undergoes partial reflection and partial refraction upon impinging on second total internal reflection plane 130 at angle C, less than critical angle A, subsequently dividing into respective partially reflected and partially refracted rays $R2_{reflect2}$ and $R2_{refract2}$. $R2_{refract2}$ is refracted out of prism 120 through second total internal reflection plane 130. The partially reflected portion of R2, $R2_{reflect2}$, leaves prism 120 via first exit facet 126.

Based on the foregoing description of the passage of light through first prism 120, it will be understood that the reflected portion of light rays having impinged upon total internal reflection planes 128 and 130 at angles less than the critical angle is considerably reduced in comparison to the reflected portion of light rays having impinged upon total internal reflection planes 128 and 130 at angles equal to or greater than the critical angle. This is due to the two-fold partial reflections of light rays impinging at angles less than the critical angle from first and second reflective facets 128 and 130, in contrast to the total reflection of light rays impinging at angles equal to or greater than the critical angle.

Figures 4A, 4B, 4C:
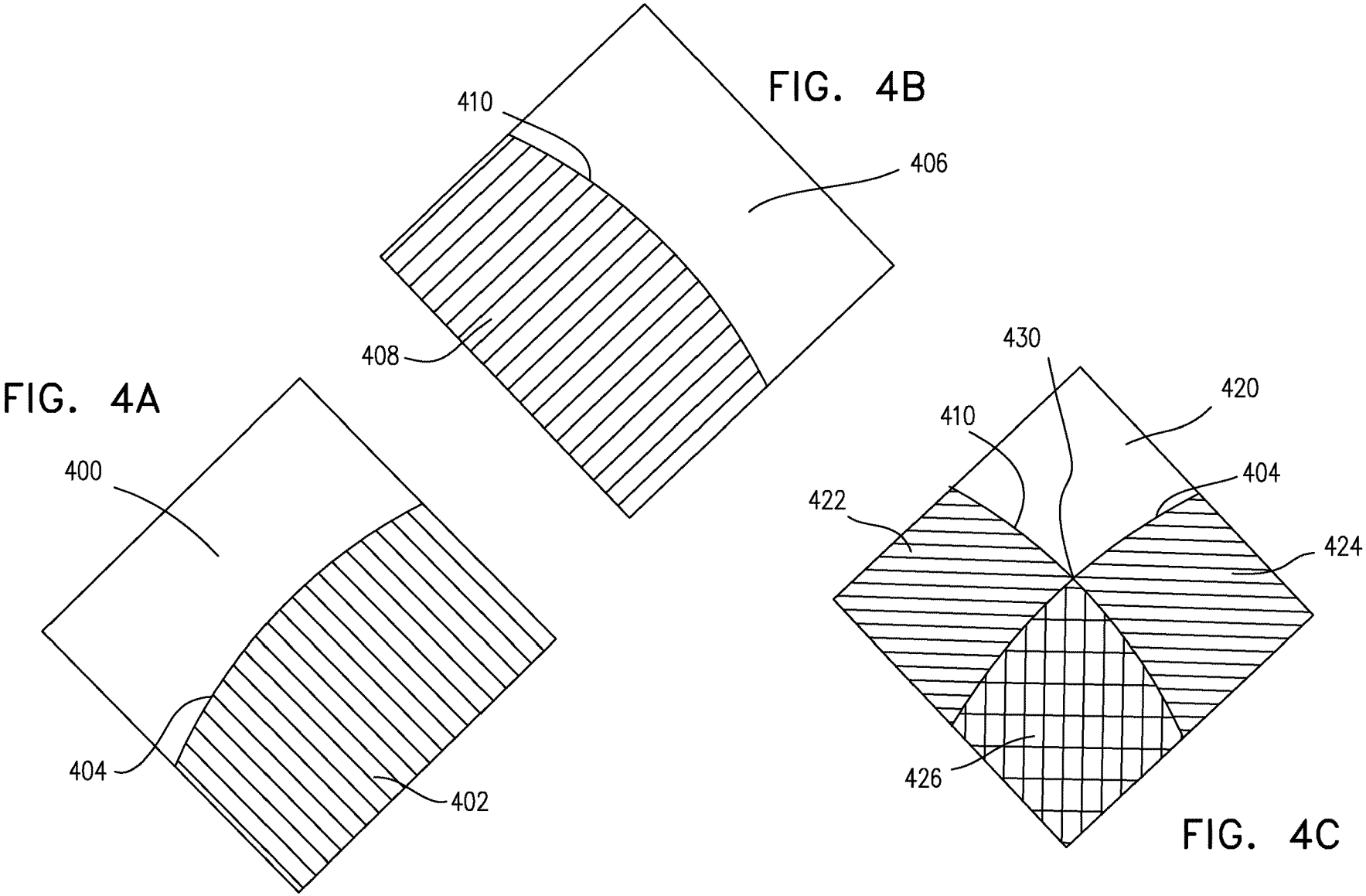
FIGS. 4A, 4B and 4C are simplified respective illustrations of a first view through a first optical element of an optical aiming device of the type illustrated in FIGS. 1 and 2; of a second view through a second optical element thereof and of a third view through both the first and second optical elements thereof.

Light rays impinging upon first and second reflective facets 128 and 130 at angles equal to or greater than the critical angle are thus fully reflected in a direction towards a user's eye. The fully reflected light rays illuminate a first region, perceived by the user as a clear or fully transparent region in the user's field of view (FOV). Referring additionally to FIG. 4A, the fully transparent illuminated region is designated by a numeral 400. It is appreciated that due to clear region 400 being created by totally internally reflected light none of which light is lost by refraction away from clear region 400, clear region 400 is extremely bright and fully transparent.

Light rays impinging upon first and second reflective facets 128 and 130 at angles less than the critical angle are only partially reflected in a direction towards a user's eye. The partially reflected light rays only partially illuminate a second region, which second region is thus perceived by the user as an opaque or partially transparent region in the user's FOV. Referring again to FIG. 4A, the partially transparent region is designated by a numeral 402. As seen in FIG. 4A, clear region 400 is immediately adjacent opaque region 402, such that a common demarcation arc 404 is defined therebetween. It is appreciated that due to opaque region 402 being created by partially reflected light, opaque region 402 is not fully opaque but rather partially transparent, allowing some visibility therethrough.

It will be readily understood by one skilled in the art that just as clear region 400, dark region 402 and common demarcation arc 404 therebetween are formed in the FOV of user 110 as a result of light reflected through first prism 120 of optical element 102, so too a clear region 406, a dark region 408 and a common demarcation arc 410 therebetween are formed in the FOV of user 110 as a result of light reflected through second prism 122 of optical element 104, as illustrated in FIG. 4B.

As appreciated from a comparison of FIGS. 4A and 4B, demarcation arc 404 is angled with respect to demarcation arc 410 as a result of the perpendiculars to the first and second reflective facets 128 and 130 of first prism 120 being angled with respect to perpendiculars to the third and fourth reflective facets 138 and 140 of second prism 122.

The combined FOV perceived by user 110 when viewing the target through both first and second optical elements 102 and 104 of optical aiming device 100 is illustrated in FIG. 4C. The user sees a quadrate structure comprising a fully transparent region 420 corresponding to the overlap of clear regions 400 and 406, a first semi-transparent region 422 corresponding to the overlap of clear region 400 and dark region 408, a second semi-transparent region 424 corresponding to the overlap of dark region 402 and clear region 406 and a minimally transparent region 426 corresponding to the overlap of dark regions 402 and 408. The transmittance of optical aiming device 100 in regions 420, 422, 424 and 426 will be further detailed below, with reference to FIGS. 5A and 5B. Regions 420, 422, 424 and 426 are demarked by demarcation arcs 404 and 410, which demarcation arcs 404 and 410 are preferably mutually angled and intersect at a point 430, which point 430 preferably lies substantially along aiming axis 106.

By aligning aiming axis 106 with target 112, as shown in FIG. 1, demarcation arc 404 corresponds to a locus of points passing through a bull's eye 432 of target 112, just as demarcation arc 410 corresponds to a locus of points passing through a bull's eye 432 of target 112, as seen in FIG. 1. Since both demarcation arcs 404 and 410 are aligned with the bull's eye 432 of the target 112, the point of intersection 430 of the demarcation arcs lies substantially along aiming axis 106 pointing to the bull's eye 432 of the target 112.

Thus, optical aiming device 100 is properly aimed by aligning two points, namely the bull's eye 432 of the target 112 and the point of intersection 430 of the demarcation arcs in the user's 110 FOV. This is in contrast to conventional aiming devices known in the art, which conventional aiming devices may require the alignment of more than two points in order to be properly aimed.

As is known in the art, optical elements 102 and 104 are preferably mounted on weapon 108 such that when axis 106 is pointed to the bull's eye 432 of the target 112, as seen in FIG. 1, an ammunition trajectory 434 also points to the bull's eye 432. The relation between the aiming axis 106 associated with optical aiming device 100 and the ammunition trajectory 434 is well known in the art, and depends on a variety of factors including distance to the target. It is appreciated that although ammunition trajectory 434 is shown to be acutely angled with respect to axis 106 in FIG. 1, ammunition trajectory 434 may lie substantially parallel to axis 106.

As mentioned above with reference to FIGS. 2 and 3, each one of totally internally reflective facets 128, 130, 138, 140 of first and second prisms 120 and 122 respectively comprising first and second optical elements 102 and 104 is coated by a multi-layer optical interference coating 300, shown in FIG. 3. The role of this multi-layer optical interference coating 300 in influencing transmittance of light through optical aiming device 100 and hence in influencing the appearance of the four quadrants 420, 422, 424 and 426 in the FOV as perceived by user 110 is now explained with reference to FIGS. 5A and 5B.

Reference is now made to FIGS. 5A and 5B, which are simplified respective graphs of overall reflection coefficients and S and P component reflection coefficients of light reflected from an optical aiming device of the type illustrated in FIG. 1.

As seen in FIG. 5A, there is provided a graph showing the reflection coefficient (% Reflectance) of a surface as a function of angle of incidence of light impinging on that surface. A first plot 502 indicates the reflection coefficient of uncoated glass and a second plot 504 indicates the reflection coefficient of glass coated by the multi-layer optical interference coating 300, for wavelengths of 530 nm in both cases. As seen in FIG. 5B, a third plot 506 and a fourth plot 508 respectively indicate the reflection coefficient of glass coated by the multi-layer optical interference coating 300 for the S and P components of light.

As evident from consideration of plots 502 and 504, the angle at which total reflection occurs from both the uncoated (plot 502) and coated (plot 504) surfaces is the same and corresponds to the critical angle A. However, the spectral characteristic of the coated surface is considerably more abrupt than that of the non-coated surface. The presence of the optical interference coating 300 thus changes the reflection coefficient of the surface on which it is disposed for angles less than the critical angle, without altering the value of the critical angle, for any wavelength. The presence of the optical interference coating 300 on the total internal reflective facets 128, 130, 138 and 140 of optical aiming device 100 therefore influences transmittance of optical aiming device 100 and thus influences the appearance of the FOV perceived by user 100 of optical aiming device 100.

For the case of first semi-transparent region 422, corresponding to the overlap of clear region 400 and dark region 408, this region is only partially transparent since it is created by light emanating from the target 112 and impinging on first and second total internal reflection facets 128 and 130 at angles equal to or greater than the critical angle A and on second and third total internal reflection facets 138 and 140 at angles less than the critical angle A. Transmittance T of aiming device 100 in region 422 may be calculated by the formula $$T=R_{coating}^{2} \tag{1}$$

wherein $R_{coating}$ is the reflectance of the multilayer optical interference coatings 300 disposed on reflective facets 138 and 140.

For the case of second semi-transparent region 424, corresponding to the overlap of dark region 402 and clear region 406, this region is only partially transparent since it is created by light emanating from the target 112 and impinging on first and second total internal reflection facets 128 and 130 at angles less than the critical angle A and on second and third total internal reflection facets 138 and 140 at angles equal to or greater than the critical angle A. Transmittance T of aiming device 100 in region 424 may be calculated in accordance with formula (1) above, but wherein $R_{coating}$ is the reflectance of the multilayer optical interference coatings 300 located on reflective facets 128 and 130.

For the case of minimally transparent region 426, corresponding to the overlap of dark regions 402 and 408, this region exhibits minimum transmittance since it is created by light emanating from the target 112 and imping on first, second, third and fourth 128, 130, 138, 140 total internal reflection facets at angles less than the critical angle A. When the plane perpendicular to reflective facets 128 and 130 is orthogonal with respect to the plane perpendicular to reflective facets 138 and 140, the transmittance T of aiming device 100 in region 426 may be given by the formula $$T=R_p^{2}*R_s^{2} \tag{2}$$

wherein $R_p$ and $R_s$ are the reflection coefficients of the multilayer optical interference coating 300 on facets 128, 130, 138, 140, for the S and P components of light.

In accordance with formulas (1) and (2), when taken in combination with the data displayed in FIGS. 5A and 5B, average transmittance in semi-transparent regions 422 and 424 is approximately 35% for a wavelength of 530 nm. Average transmittance in minimally transparent region 426 is approximately 7% for a wavelength of 530 nm.

As will be appreciated from consideration of formulas (1) and (2) above, when taken in combination with the data displayed in FIGS. 5A and 5B, the presence of multilayer optical interference coatings 300 thus serves to significantly increase transmittance in semi-transparent regions 422 and 424. Transmittance in region 426 is furthermore maintained at a sufficiently low level so as to provide proper contrast between respective regions 422 and 424 and interfacing region 426. The resolution of aiming device 100 is thereby significantly improved.

As will be readily understood by one skilled in the art, the presence of multilayer optical interference coatings 300 does not generally affect the transmittance of fully transparent region 420, since multilayer optical interference coatings 300 do not alter the critical angle A at which total internal reflection takes place from the surface on which the coating 300 is disposed.

It is appreciated that optical aiming device 100 of the present invention, including multilayer optical interference coatings 300, thus advantageously provides a clearer FOV and improved resolution, in comparison to the FOV and resolution that would be provided in the absence of optical interference coatings 300. Furthermore, the different transmittances in the various regions of the FOV allow the user to select the most appropriate region in the FOV through which to sight the target, in accordance with the lighting conditions under which the user operates. Advantageously, due to even the opaque regions in the FOV being partially illuminated and therefore having some transparency, the user has some, albeit limited, visibility over the entire FOV.

A multilayer optical interference coating suitable for use in a preferred embodiment of the present invention may comprise alternating layers of Zinc Sulfide (ZnS) and Magnesium Fluoride ($MgF_2$), preferably formed on a glass substrate with a refractive index of n=1.5. Possible parameters of such a coating are presented in the table below, which table lists the layer number, material of which the layer is formed and physical layer thickness, for each layer of a preferred embodiment of the multilayer optical interference coating.

| Layer No. | Layer Material | Layer thickness (nm) |
|---|---|---|
| Air | | |
| 1 | ZnS | 63 |
| 2 | $MgF_2$ | 135 |
| 3 | ZnS | 64 |
| 4 | $MgF_2$ | 138 |
| 5 | ZnS | 65 |
| 6 | $MgF_2$ | 139 |
| 7 | ZnS | 75 |
| 8 | $MgF_2$ | 241 |
| 9 | ZnS | 71 |
| 10 | $MgF_2$ | 137 |
| 11 | ZnS | 64 |
| 12 | $MgF_2$ | 141 |
| 13 | ZnS | 109 |
| 14 | $MgF_2$ | 188 |
| 15 | ZnS | 65 |
| glass | | |

It is appreciated that the above tabulated structure of a multilayer optical interference coating suitable for incorporation in a preferred embodiment of the optical aiming device of the present invention is exemplary only and that other multilayer optical interference coatings may alternatively be used, as are well known in the art. These may include coatings comprising different materials, a different numbers of layers and/or layers of different thicknesses in comparison to those listed herein.

It is further appreciated that although in the description corresponding to FIGS. 2-5B hereinabove, reference to a single multilayer optical interference coating 300 is made, the use of multiple different multilayer optical interference coatings on one or more of the various total internal reflection facets of the optical elements 102 and 104 is also envisioned and is included in the scope of the present invention, as will be detailed henceforth.

The material of which prisms 120 and 122 are formed may cause some dispersion of light therethrough. This dispersion is due to the fact that the critical angle associated with total internal reflection is a function of wavelength; the longer the wavelength, the larger the critical angle. In the case that each one of optical elements 102 and 104 comprises only a single prism such as respective prisms 120 and 122, dispersion of light may occur at the demarcation arcs because the total internal reflection is not confined to occurring at one definite plane, but rather at slightly overlapping planes, each corresponding to slightly different wavelength. This dispersion is generally at the blue color wavelength and creates a blue streak in the FOV.

The blue streak may not irritate a user. However, the blue streak may be eliminated by the formation of each one of optical elements 102 and 104 from more than one prism, the multiple prisms having different optical dispersion characteristics i.e. achromatization, as is well known in the art.

Figure 6:
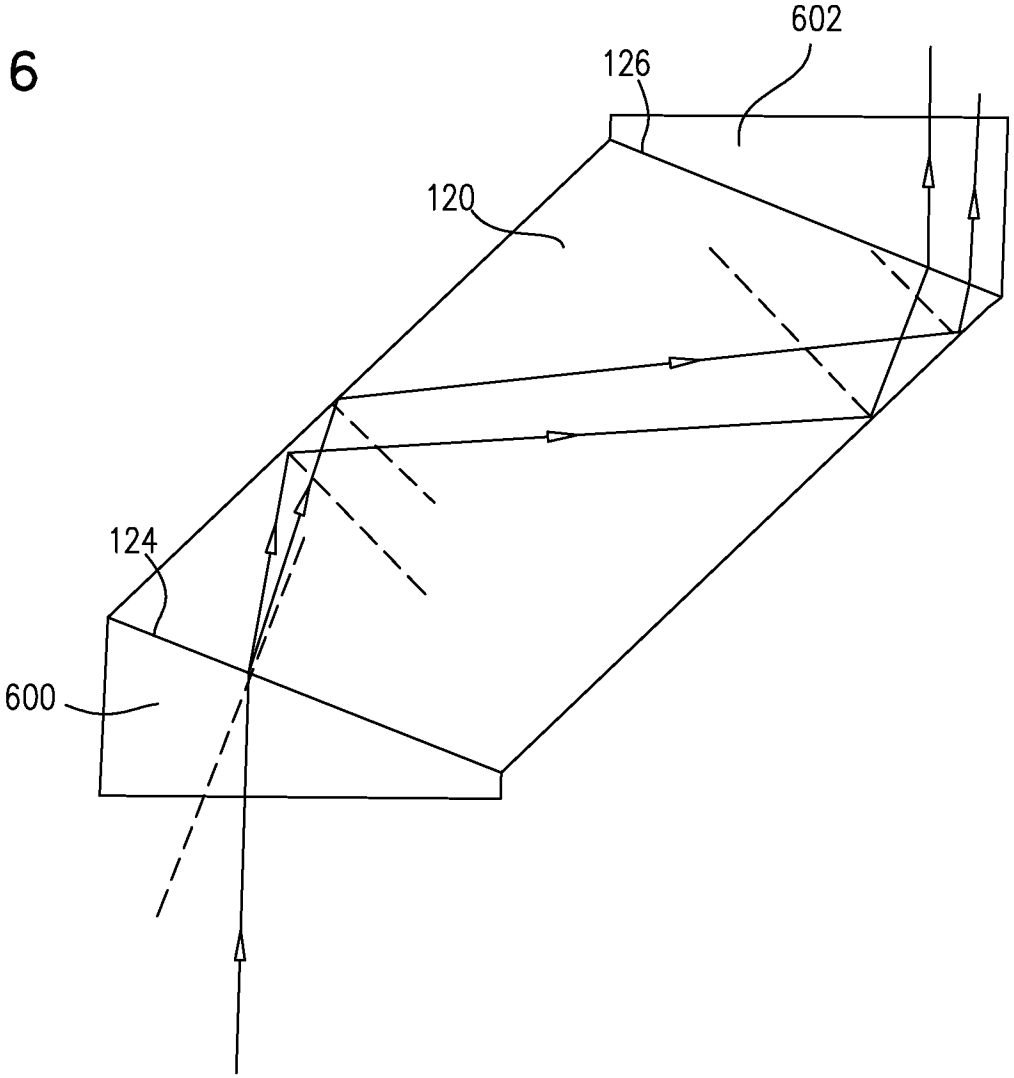
FIG. 6 is a simplified side view illustration of an optical element of an optical aiming device constructed and operative accordance with another preferred embodiment of the present invention, depicting light impinging thereon.

FIG. 6 illustrates such an arrangement for the case of prism 120 shown in FIG. 3. As seen in FIG. 6, an additional first and second wedge prism 600 and 602 may be provided abutting prism 120 on either side thereof. First wedge prism 600 may abut entry facet 124 and second wedge prism 602 may abut exit facet 126 of prim 120. Prism 120 may be formed of BK7 glass and wedge prisms 600 and 602 may be formed of SF4 glass. BK7 and SF4 glasses have compensating optical dispersion characteristics, thus substantially reducing the visibility of the blue streak. In this case, light impinging on the total internal reflection planes of prisms 120 and 122 is achromatic.

The structure presented in FIG. 6 may alternatively be used for altering the color of demarcation arcs 404 and 410 of FIG. 4C, rather than for purposes of achromatization. In this application, parameters of prisms 120, 600 and 602 may be selected so as to alter the color of the demarcation arcs, for example to produce generally red demarcation arcs having width of approximately 0.0005-0.002 radians, such that light impinging on the total internal reflection planes of prisms 120 and 122 is at least partially chromatic. Such colored demarcations arcs may be advantageous due to the contrast formed between the colored demarcation arcs and the background, allowing the demarcation arcs to be more easily distinguished by a user and improving the visibility thereof. The exact color of the demarcation arcs will depend on the parameters of prisms 120, 600 and 602 as well as the structure of multi-layer optical reflective coatings 300 formed thereon. By way of example, prism 120 may be formed of BK7 glass with a sharp angle of approximately 77.50 and prisms 600 and 602 be formed of SF57 glass with sharp angles of approximately 29.1°.

Figure 7:
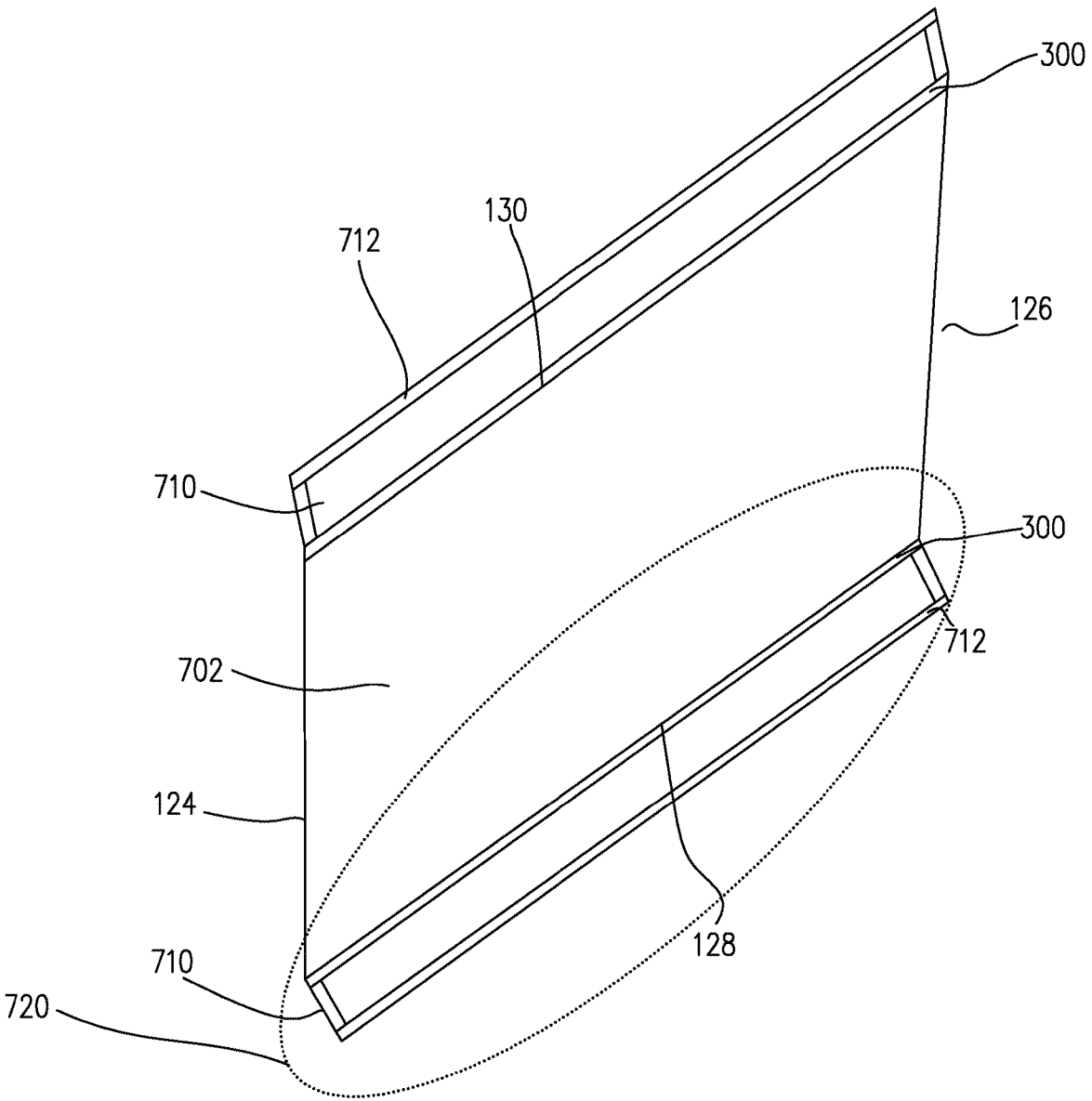
FIG. 7 is a simplified side view illustration of an optical element of an optical aiming device constructed and operative in accordance with a further preferred embodiment of the present invention.

Each one of optical elements 102 and 104 may additionally include other optical structures in addition to prisms 120 and 122 having multilayer optical interference coatings 300 thereon, as seen, by way of example, in the case of an optical element 702 illustrated in FIG. 7.

Optical element 702 is an alternative possible embodiment of optical element 102, for incorporation in a further preferred embodiment of an optical aiming device of the present invention. It will be readily understood by one skilled in the art that modifications substantially the same as those made with respect to optical element 102 so as to form optical element 702 may be made to optical element 104 to as to form a corresponding additional identically modified optical element sharing the same properties as those described herein below with respect to optical element 702. An optical aiming device constructed and operative in accordance with a preferred embodiment of the present invention may include two identical optical elements corresponding to optical element 702, the two optical elements being mutually located as described above with reference to FIG. 2 and optical elements 102 and 104 illustrated therein.

As seen in FIG. 7, optical element 702 may resemble optical element 102 in every relevant respect, with the exception of optical element 702 including an additional spacer layer 710 formed atop of each multilayer optical interference coating 300 and a further additional mirror 712 formed atop of each spacer layer 710. Spacer layer 710 and mirror 712 are preferably formed atop of each multilayer optical interference coating 300 on each one of first and second reflective facets 128 and 130. Mirrors 712 are preferably mounted parallel to multilayer optical interference coatings 300. Spacer layers 710 and mirrors 712 preferably have a length substantially equal to a length of each one of first and second reflective facets 128 and 140, as seen in FIG. 7.

Figure 8A:
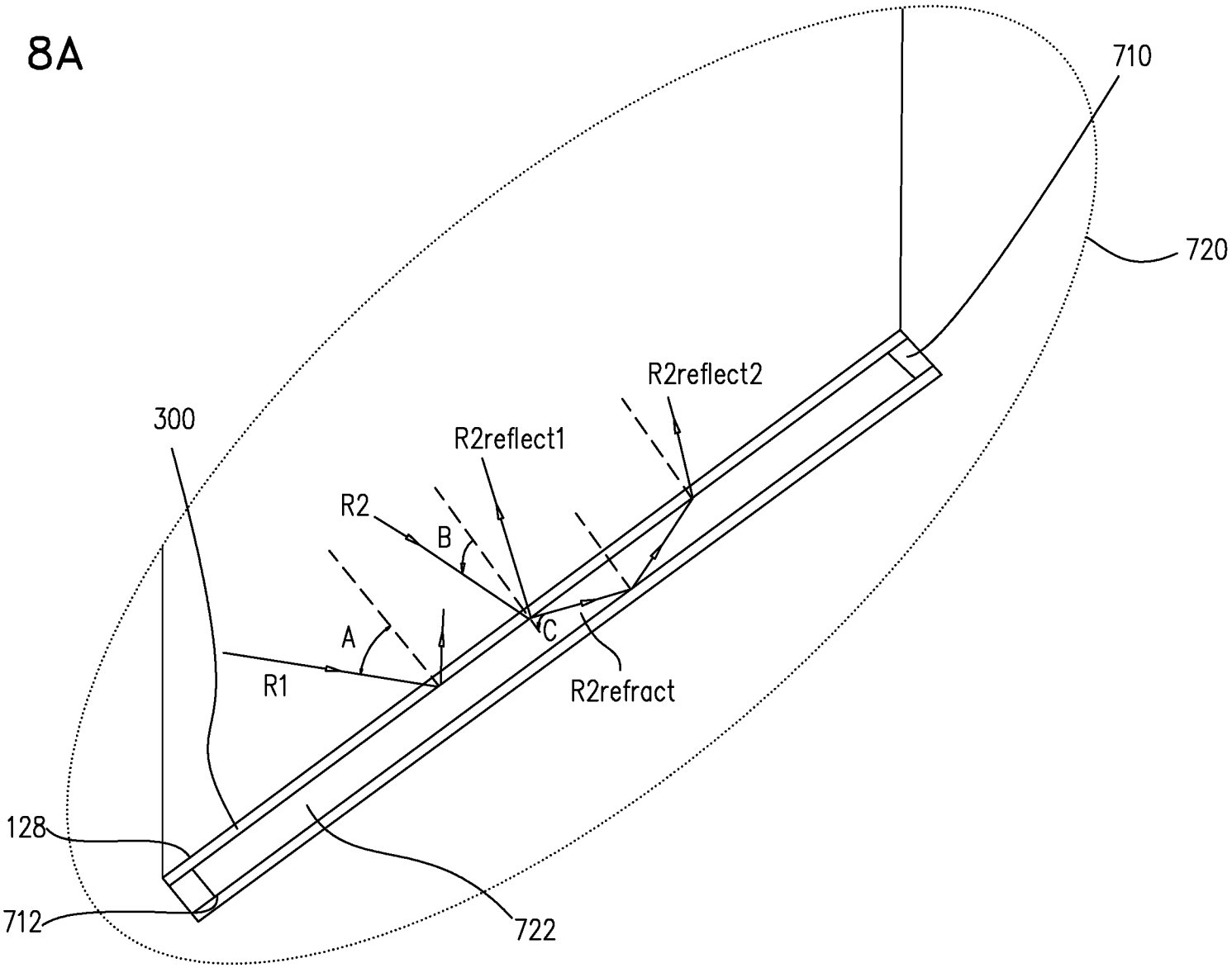
FIGS. 8A and 8B are simplified first and second enlarged view illustrations of a portion of an optical element of an optical aiming device of the type illustrated in FIG. 7, depicting rays of light impinging thereon.

As seen most clearly at enlargement 720, illustrated in FIG. 8A, a first typical ray of light R1 may impinge on first reflective facet 128 and multi-layer optical coating 300 thereon, at an angle equal to or greater than the critical angle A, for example at an angle equal to the critical angle A, as shown in FIG. 8A. R1 undergoes total internal reflection at first reflective facet 128 and therefore does not pass into an empty space 722 behind coating 300, which empty space 722 is preferably formed by spacers 710. At angles equal to or greater than the critical angle A, optical element 702 therefore remains completely transparent to impinging light, as is the case for optical element 102 described above with reference to FIG. 3.

A second typical ray of light R2 may impinge on first reflective facet 128 and multilayer optical coating 300 thereon at an angle B, less than but close to the critical angle A. R2 will be partially reflected at first reflective facet 128, as depicted by a reflected portion $R2_{reflect1}$, and will be partially refracted into empty space 722, as depicted by refracted portion $R2_{refract}$. The subsequent passage of $R2_{refract}$ following the entry thereof into empty space 722 depends on the angle of refraction C of $R2_{refract}$.

Figure 8B:
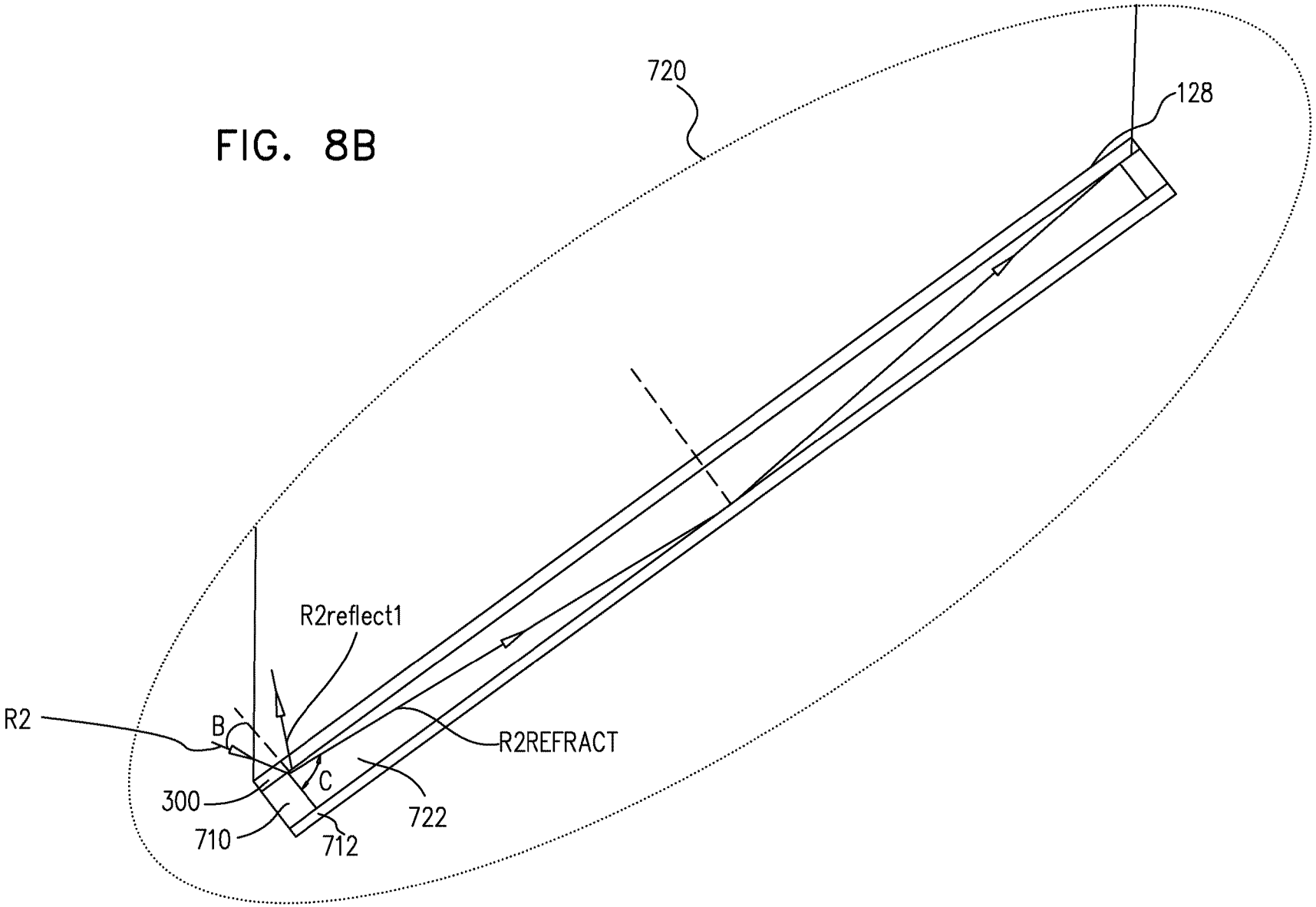

As best seen at enlargement 720 in FIG. 8B, if the angle of refraction C of refracted ray $R2_{refract}$ satisfies:

$$\text{arctg}(L/2H)<C<90° \quad (3)$$

then $R2_{refract}$ will pass into empty space 722, will be subsequently reflected by mirror 712, will be trapped in empty space 722 and will finally be absorbed by spacers 710, as illustrated in FIG. 8B. In formula (3), L corresponds to a length of empty space 722 and H corresponds to a width of empty space 722.

As best seen at enlargement 720 in FIG. 8A, if the angle of refraction C of refracted ray $R2_{refract}$ satisfies:

$$C<\text{arctg}(L/2H) \quad (4)$$

then $R2_{refract}$ will pass into empty space 722, will subsequently be reflected by mirror 712 and will return into prism 120 as $R2_{reflect2}$, parallel to and offset from $R2_{reflect1}$.

As will be appreciated from the foregoing description of the interaction of rays R1 and R2 with reflective facet 128 of optical element 702, almost all of the rays impinging on first reflective facet 128 will be reflected from reflective facet 128 and only rays having a narrow refractive angle falling within the range specified by formula (3) will be trapped within empty space 722. Similarly, due to the symmetry of optical element 702, the same effect would be expected to take place with respect to rays impinging on parallel opposite second reflective facet 130.

As a result of almost all of the light impinging on optical element 702 being totally reflected in a direction towards user 110 and only a small portion thereof being refracted away from user 110, transmittance is high in the entire FOV seen by user 110, with the exception of in a narrow band having an angular width corresponding to the range of angles circumscribed by formula (3). Referring additionally to FIG. 9A, the transparent or clear region in the FOV is designated by a numeral 900 and the band of lower transmittance is designated by a numeral 902. As will be appreciated from a comparison of FIG. 9A to FIG. 4A, a shape of band 902 is similar to a shape of demarcation arc 404.

Transmittance T in band 902 may be calculated in accordance with the formula $$T=(R_p^2+R_s^2)*0.5 \quad (5)$$

wherein $R_p$ and $R_s$ are the reflection coefficients of the multilayer optical interference coating 300 on facets 128 and 130 in the angular range defined by formula (3) for the S and P components of light.

Figure 9B:
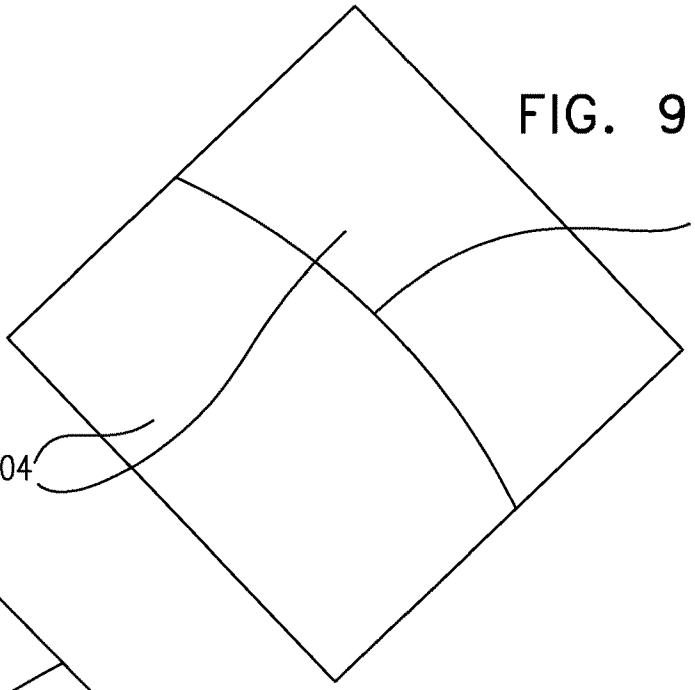
FIGS. 9A, 9B and 9C are simplified respective illustrations of a first view through a first optical element of an optical aiming device of the type illustrated in FIG. 7; of a second view through a second optical element thereof and of a third view through both the first and second optical elements thereof.

It will be readily understood by one skilled in the art that just as clear regions 900 and opaque band 902 are formed in the FOV of user 110 as a result of light reflected through first optical element 702, so too clear regions 904 and an opaque band 906 as shown in FIG. 9B are formed in the FOV of user 110 as a result of light reflected through a second optical element resembling first optical element 702 but being angled with respect thereto, in the manner of that described above with respect to the mutual arrangement of first and second optical elements 102 and 104.

As appreciated from a comparison of FIGS. 9A and 9B, opaque band 902 is angled with respect to opaque band 906, as a result of the perpendiculars of the first and second reflective facets 128 and 130 of optical element 702 being angled with respect to perpendiculars of the reflective facets of a second optical element, generally corresponding to optical element 702.

Figure 9C:
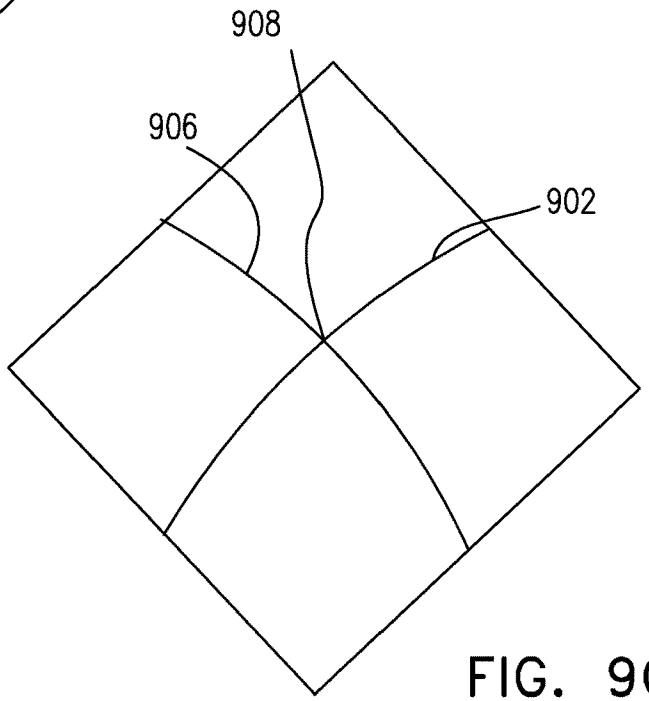
Figure 9A:
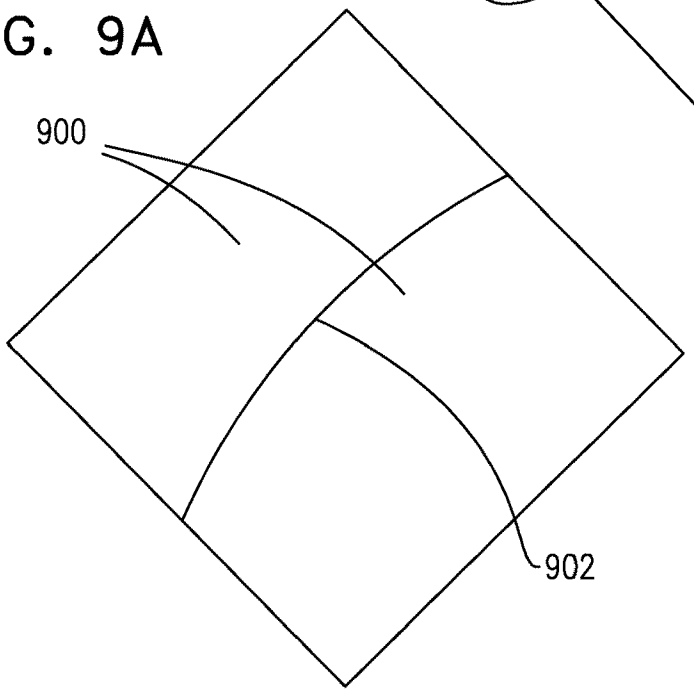

The combined FOV perceived by user 110 when viewing the target through first optical element 702 and the second optical element corresponding thereto is illustrated in FIG. 9C. Opaque bands 902 and 906 intersect at a common point 908. Since both bands 902 and 906 are aligned with the bull's eye 432 of the target 112, the point of intersection 908 of the bands lies substantially along aiming axis 106 pointing to the bull's eye 432 of the target 112.

As appreciated from consideration of FIG. 9C, almost the entire FOV is clear, with the exception of in narrow bands 902 and 906 where transmittance is considerably less. This is a particularly advantageous feature of this embodiment of the present invention, since it allows user 110 to easily sight the target 112 at almost any point in the FOV.

Figure 10:
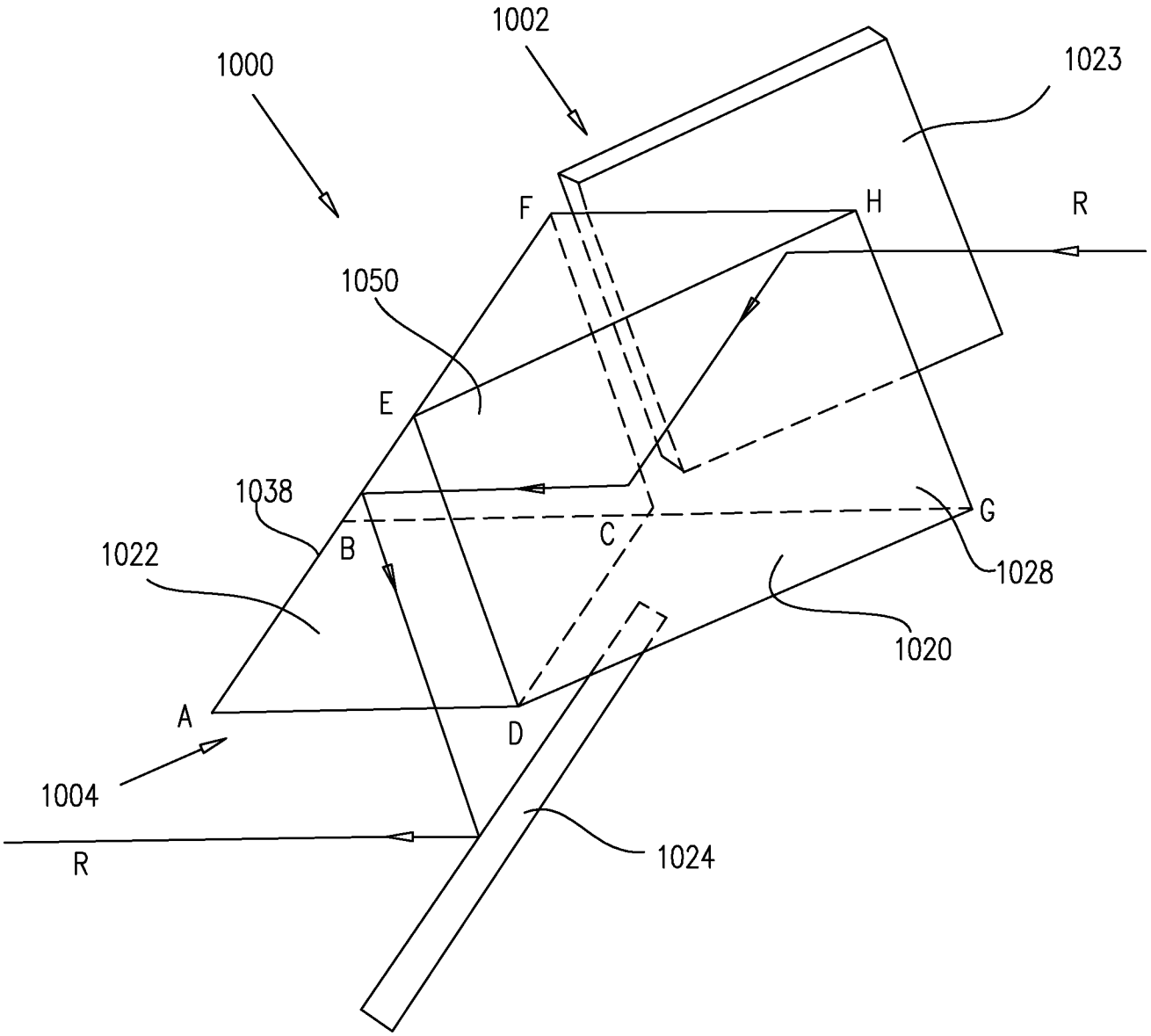
FIG. 10 is a simplified perspective view illustration of an optical aiming device constructed and operative in accordance with yet another preferred embodiment of the present invention.
Figure 11:
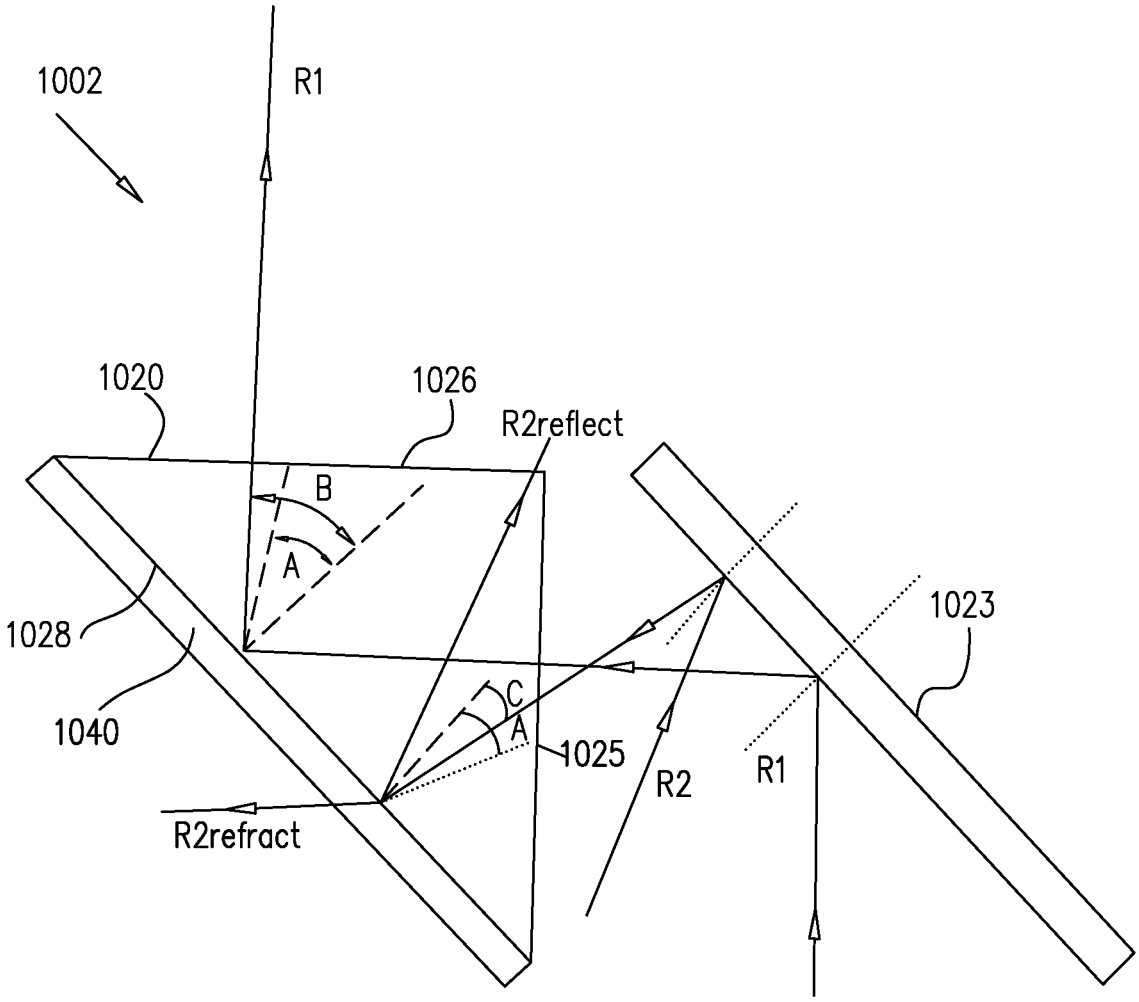
FIG. 11 as 12 are simplified side view illustrations of respective first and second optical elements of an optical aiming device of the type shown in FIG. 10, depicting light impinging thereon.
Figure 12:
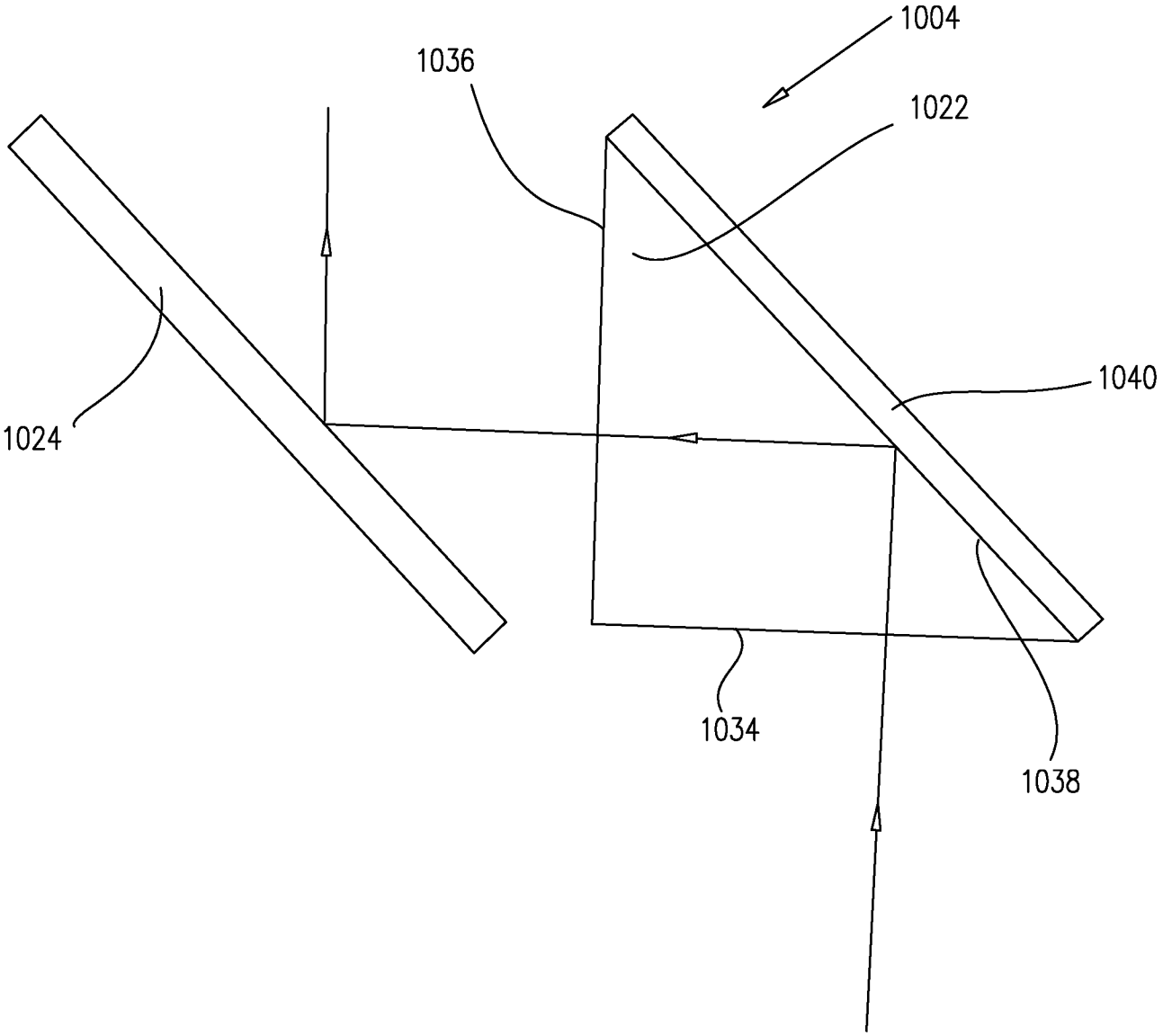

Reference is now made to FIG. 10, which is a simplified perspective view illustration of an optical aiming device constructed and operative in accordance with yet another preferred embodiment of the present invention, and to FIGS. 11 and 12, which are simplified side view illustrations of respective first and second optical elements of an optical aiming device of the type shown in FIG. 10, depicting light impinging thereon.

As seen in FIG. 10, there is provided an optical device 1000 for aiming light, preferably including a first optical element 1002 and a second optical element 1004, which second optical element 1004 is preferably juxtaposed to first optical element 1002. First optical element 1002 preferably lies generally on an axis, such as on aiming axis 106 shown in FIG. 1.

Each one of first and second optical elements 1002 and 1004 preferably comprises a multi-faceted optical element, here embodied, by way of example, as respective first and second triangular prisms 1020 (EDCFHG) and 1022 (ABCDEF). It is appreciated, however, that first and second optical elements 1002 and 1004 are not limited to being formed as triangular prisms of the particular shape illustrated in FIG. 10 and rather may be embodied as a variety of other shaped prisms. First optical element 1002 preferably additionally includes a first folding mirror 1023 associated with first triangular prism 1020. Second optical element 1004 preferably additionally includes a second folding mirror 1024 associated with second triangular prism 1022.

As seen most clearly in FIG. 11, first triangular prism 1020 comprising first optical element 1002 preferably includes a first entry facet 1025, through which light emanating from a target towards first mirror 1023 and reflected from first mirror 1023, may enter first triangular prism 1020. First triangular prism 1020 further includes a first exit facet 1026, through which light having propagated through prism 1020 may exit first optical element 1002. First prism 1020 is characterized by a refractive index and a critical angle, these defining at least one total internal reflection plane formed by at least one facet thereof. Here, by way of example, a total internal reflection plane of first triangular prism 1020 may be formed by a first reflective facet 1028, at which first reflective facet 1028 total internal reflection may occur.

First and second triangular prisms 1020 and 1022 respectively forming first and second optical elements 1002 and 1004 may be mutually optically identical. Thus, as seen most clearly in FIG. 12, second triangular prism 1022 of second optical element 1004 preferably includes a second entry facet 1034, though which light emerging from first optical element 1002 may enter second optical element 1004 and a second exit facet 1036, through which light having propagated through second prism 1022 may exit prism 1022 in a direction towards second mirror 1024. Second prism 1022 is characterized by a refractive index and a critical angle defining at least one total internal reflection plane formed by at least one facet thereof, which refractive index and critical angle are preferably the same as the refractive index and critical angle associated with first prism 1020. Here, by way of example, a total internal reflection plane of second prism 1022 is preferably formed by a second reflective facet 1038, at which second reflective facet 1038 total internal reflection may occur.

A multi-layer interference optical coating 1040 may be formed on each one of first and second reflective facets 1028 and 1038 in order to modify the reflective properties thereof and thereby improve the field of view provided to user 110 of optical aiming device 1000. The multi-layer interference optical coatings 1040 formed on first and second reflective facets 1028 and 1038 are preferably mutually identical, although it is envisioned that the multi-layer interference optical coatings formed on the two reflective facets may alternatively be mutually different.

As best seen in FIG. 10, the two optical elements 1002 and 1004 are preferably oriented such that a plane perpendicular to the first reflective facet 1028 of first prism 1020 is angled with respect to a plane perpendicular to the second reflective facets 1038 of second prism 1022. The angle between the perpendiculars is preferably about 90°±15°.

First and second optical elements 1002 and 1004 are preferably separated by a gap, here shown, by way of example, to be embodied as a gap 1050 formed between mutually juxtaposed first exit facet 1026 of first prism 1020 and second entry facet 1034 of second prism 1022. Gap 1050 preferably comprises a material having a refractive index equal or substantially similar to that of first and second prisms 1020 and 1022.

As appreciated from consideration of the path of a typical light beam R shown propagating through optical aiming device 1000 in FIG. 10, first mirror 1023 of first optical element 1002 preferably forms an entry facet of optical aiming device 1000 with respect to light emanating from a target and second mirror 1024 of second optical element 1004 preferably forms an exit facet of optical aiming device 1000 with respect to light propagated towards user 110.

As best seen in FIG. 11 for the case of first optical element 1002, a first typical ray of light R1 and a second typical ray of R2, both emanating from a target but at differing angles, may impinge on folding mirror 1023 and be reflected towards first entry facet 1025 of first triangular prism 1020. First and second rays of light R1 and R2 may enter first triangular prism 1020 via entry facet 1025, and propagate through first triangular prism 1020 a direction towards first total internal reflection plane 1028.

First ray of light R1 may impinge on first total internal reflection plane 1028 at an angle equal to or greater than a critical angle A, such as at an angle B. In this case, first ray of light R1 undergoes total internal reflection at first total internal reflection plane 1028, in a direction towards first exit facet 1026. The totally reflected ray R1 subsequently leaves first prism 1020 via first exit facet 1026 in a direction towards second optical element 1004.

Second ray of light R2 may impinge on first total internal reflection plane 1028 at an angle less than critical angle A, such as at an angle C. In this case, one portion $R2_{reflect}$ of second ray of light R2 is partially reflected from first total internal reflection plane 1028 and another portion $R2_{refract}$ is partially refracted through total internal reflection plane 1028. That portion $R2_{reflect}$ subsequently leaves first prism 1020 via first exit facet 1026 in a direction towards second optical element 1004. That portion $R2_{refract}$ is refracted out of prism 1020 through first total internal reflection plane 1028.

Based on the foregoing description of the passage of light through first triangular prism 1020, it will be understood that the reflected portion of light rays having impinged upon total internal reflection plane 1028 at angles less than the critical angle is considerably reduced in comparison to the reflected portion of light rays having impinged upon total internal reflection plane 1028 at angles equal to or greater than the critical angle. This is due to the only partial reflection of light rays impinging at angles less than the critical angle from first reflective facet 1028, in contrast to the total reflection of light rays impinging at angles equal to or greater than the critical angle.

Figure 13A:
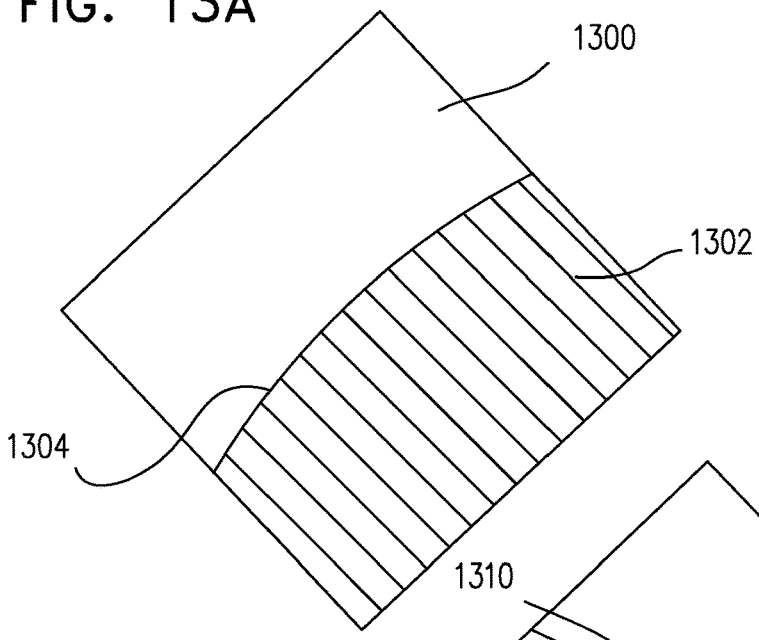
FIGS. 13A, 13B and 13C are simplified respective illustrations of a first view through a first optical element of an optical aiming device of the type illustrated in FIG. 10, of a second view through a second optical element thereof and of a third view through both first and second optical elements thereof.

Light rays impinging upon first reflective facet 1028 at angles equal to or greater than the critical angle are thus fully reflected in a direction towards a user's eye. The fully reflected light rays illuminate a first region, perceived by the user as a clear or fully transparent region in the user's FOV. Referring additionally to FIG. 13A, the fully transparent illuminated region is designated by a numeral 1300. It is appreciated that due to clear region 1300 being created by totally internally reflected light none of which light is lost by refraction away from clear region 1300, clear region 1300 is extremely bright and fully transparent.

Light rays impinging upon first reflective facet 1028 at angles less than the critical angle are only partially reflected in a direction towards a user's eye. The partially reflected light rays only partially illuminate a second region, which second region is thus perceived by the user as a dark or partially transparent region in the user's FOV. Referring again to FIG. 13A, the partially transparent region is designated by a numeral 1302. As seen in FIG. 13A, clear region 1300 is immediately adjacent dark region 1302, such that a common demarcation arc 1304 is defined therebetween. It is appreciated that due to opaque region 1302 being created by partially reflected light, opaque region 1302 is not fully opaque but rather partially transparent, allowing some visibility therethrough.

Figure 13B:
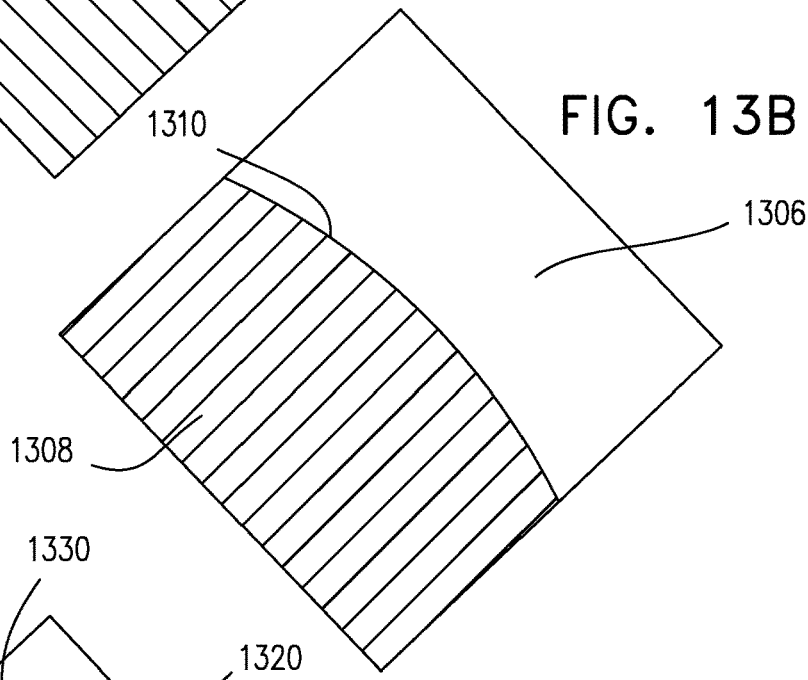

It will be readily understood by one skilled in the art that just as clear region 1300, dark region 1302 and common demarcation arc 1304 therebetween are formed in the FOV of a user as a result of light reflected through first triangular prism 1020 of first optical element 1002, so too a clear region 1306, a dark region 1308 and a common demarcation arc 1310 therebetween are formed in the FOV of the user as a result of light reflected through second triangular prism 1022 of second optical element 1004, as illustrated in FIG. 13B. As best seen in FIG. 12, light enters second optical element 1004 via second entry facet 1034, impinges on second total internal reflection plane 1038 and consequently undergoes total reflection thereat for angles of incidence greater than or equal to the critical angle A, as shown, and partial reflection and partial refraction for angles of incidence less than the critical angle A (not shown). The reflected portion of the light then leaves second triangular prism 1022 via second exit facet 1036, impinges on second folding mirror 1024 and leaves second optical element 1004 in a direction towards the user.

As will be appreciated from a comparison of FIGS. 13A and 13B, demarcation arc 1304 is angled with respect to demarcation arc 1310 as a result of the perpendiculars to the first and second reflective facets 128 and 138 of first and second prisms 1020 and 1022 being mutually angled.

Figure 13C:
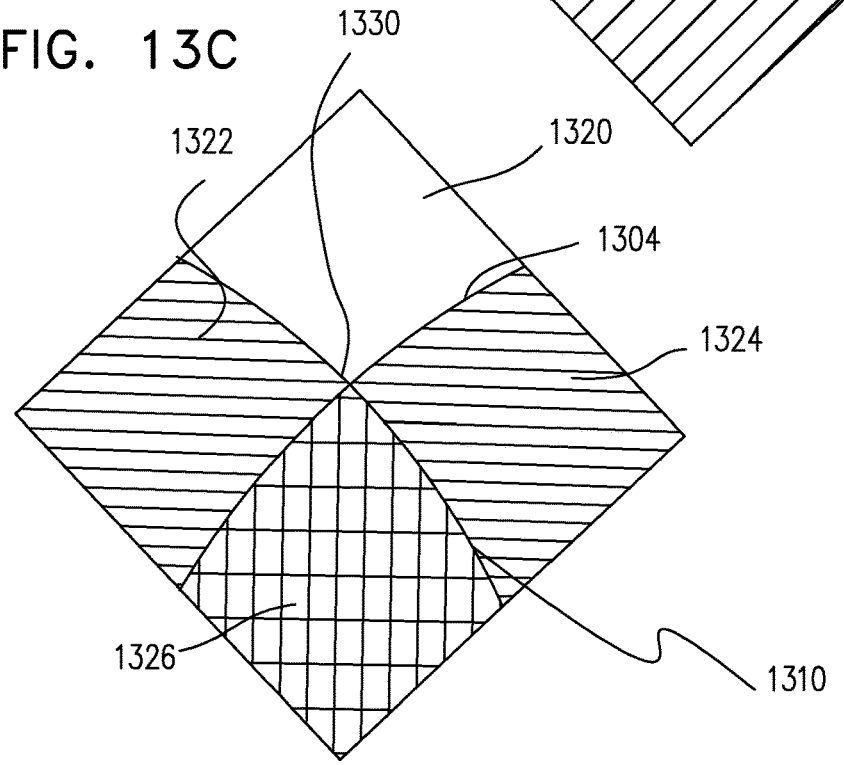

The combined FOV perceived by the user when viewing the target through both first and second optical elements 1002 and 1004 of optical aiming device 1000 is illustrated in FIG. 13C. The user sees a quadrate structure comprising a fully transparent region 1320 corresponding to the overlap of clear regions 1300 and 1306, a first semi-transparent region 1322 corresponding to the overlap of clear region 1300 and dark region 1308, a second semi-transparent region 1324 corresponding to the overlap of dark region 1302 and clear region 1306 and a minimally transparent region 1326 corresponding to the overlap of dark regions 1302 and 1308. Regions 1320, 1322, 1324 and 1326 are demarked by demarcation arcs 1304 and 1310, which demarcation arcs 1304 and 1310 are preferably mutually angled and intersect at a point 1330, which point 1330 preferably lies substantially along an aiming axis, such as aiming axis 106.

As described above with reference to optical aiming device 100, by aligning aiming axis 106 with target 112, as shown in FIG. 1, demarcation arc 1304 corresponds to a locus of points passing through a bull's eye 432 of target 112, just as demarcation arc 1310 corresponds to a locus of points passing through the bull's eye 1332 of target 112, as seen in FIG. 1. Since both demarcation arcs 1304 and 1310 are aligned with the bull's eye 432 of the target 112, the point of intersection 1330 of the demarcation arcs lies substantially along aiming axis 106 pointing to the bull's eye 432 of the target 112.

Thus, optical aiming device 1000 is properly aimed by aligning two points, namely the bull's eye 432 of the target 112 and the point of intersection 1330 of the demarcation arcs in the user's 110 FOV. This is in contrast to conventional aiming devices known in the art, which conventional aiming devices may require the alignment of more than two points in order to be properly aimed.

The presence of multilayer optical interference coatings 1040 serves to significantly increase transmittance in semi-transparent regions 1322 and 1324. Transmittance in region 1326 is furthermore maintained at a sufficiently low level so as to provide proper contrast between respective regions 1322 and 1324 and interfacing region 1326. The resolution of aiming device 1000 is thereby significantly improved, as described above with reference to FIGS. 5A and 5B. Advantageously, due to even the opaque regions in the FOV being partially illuminated and therefore having some transparency, the user has some, albeit limited, visibility over the entire FOV.

As will be appreciated from a comparison of the FOV shown in FIGS. 13A-13C to the FOV shown in FIGS. 4A-4C, optical aiming device 1000 may provide a similar FOV as optical aiming device 100. However, optical aiming device 1000 has the advantage of being more light-weight than optical aiming 100, due to the lighter weight of triangular prisms 1020 and 1022 in comparison to the weight of prism-parallelograms 120 and 122 for the same sized entry facet.

An additional advantage of optical aiming device 1000 in comparison to optical aiming device 100 is the possibility of storing optical aiming device 1000 in a compact configuration when not in use. This may be achieved by making folding mirrors 1023 and 1024 rotatable around a rotation axis, such as a rotation axis 1400 shown in the case of first optical element 1002 in FIG. 14. Rotation axis 1400 may lie in the same plane as first folding mirror 1023, parallel to planes of the first entry and exit facets 1025, 1026. Folding mirror 1023 may be rotated from a first functional extended position, indicated by solid lines, to a second non-functional, folded position, indicated by broken lines, in which second folded position folding mirror 1023 is held adjacent to entry facet 1025 of first triangular prism 1020.

Figure 14:
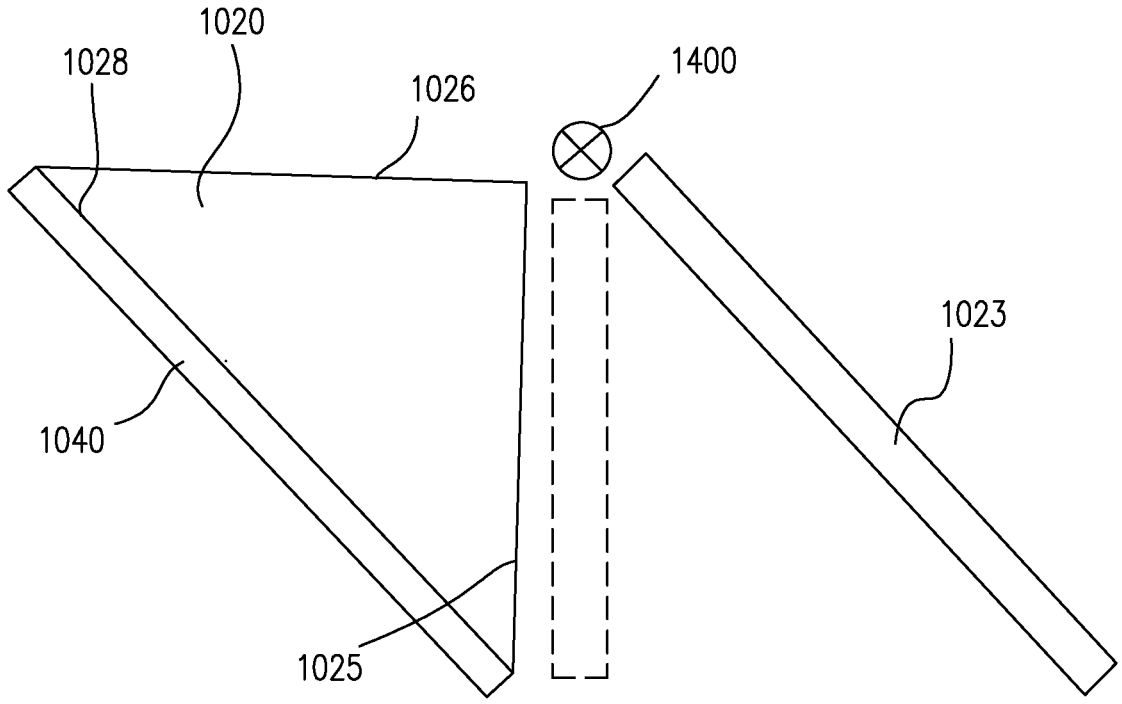
FIG. 14 is a simplified side view illustration of an optical element of an optical aiming device, constructed and operative in accordance with yet a further preferred embodiment of the present invention.

As appreciated from consideration of FIG. 14, a volume of first optical element 1002 when mirror 1023 is in its second folded position is almost half of that of first optical element 1002 when mirror 1023 is in its first extended position. As will be readily understood, second folding mirror 1024 included in second optical element 1004 may be similarly rotated, such that a volume of optical aiming device 1000 when not in use may be significantly reduced. This is a particularly advantageous feature of optical aiming device 1000, allowing optical aiming device 1000 to be stored in a highly compact manner when not in use.

Furthermore, the folding of mirrors 1023 and 1024 over respective first entry facet 1025 and second exit facet 1036, offers protection of respective first entry facet 1025 and second exit facet 1036 when optical aiming device 1000 is not in use.

Figure 15:
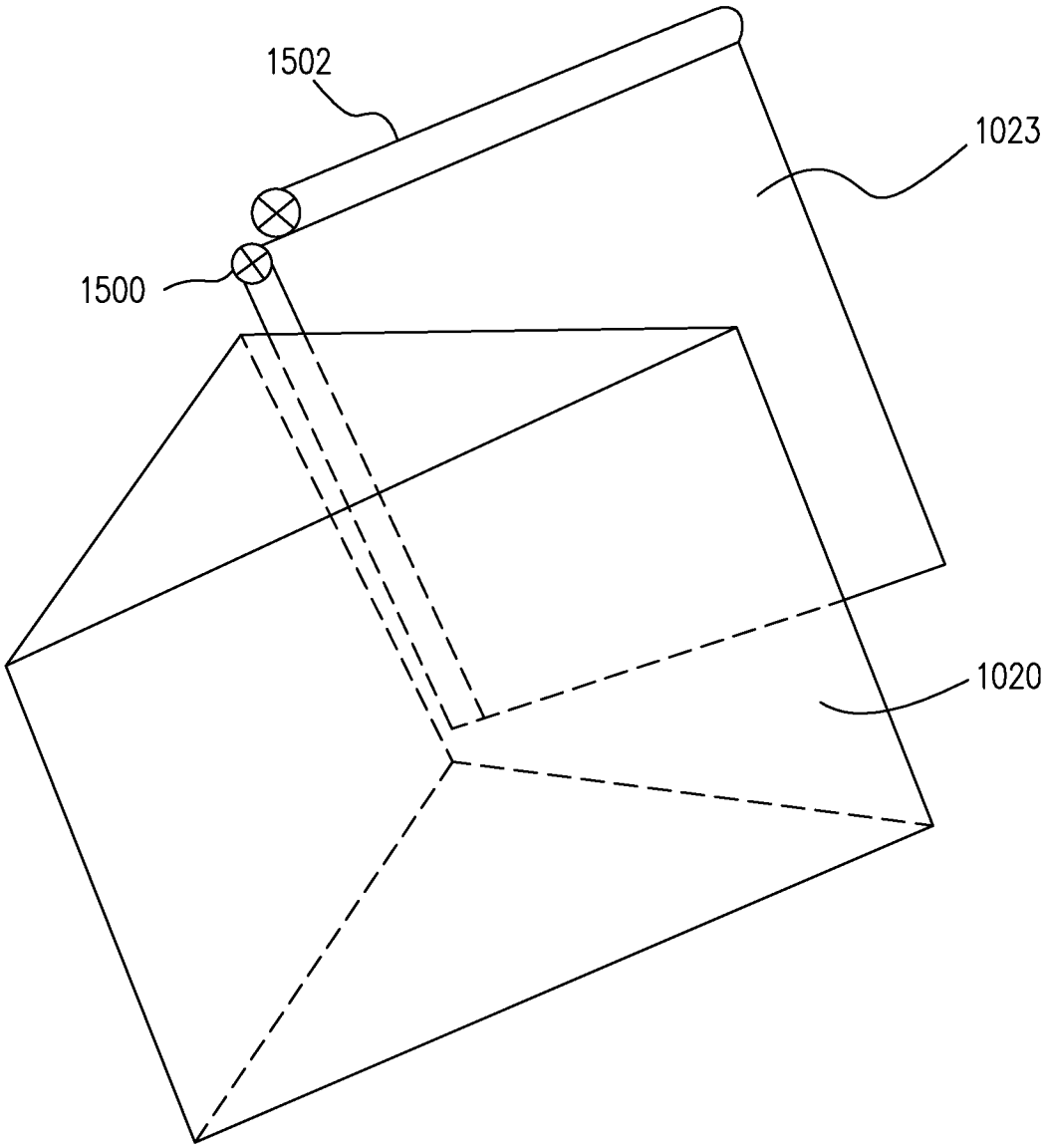
FIG. 15 is a simplified perspective view illustration of an optical element of an optical aiming device, constructed and operative in accordance with still another preferred embodiment of the present invention.

Additionally, optical aiming device 1000 may be further modified so as to permit adjustment of the optical axis of weapon 108. This may be achieved by making folding mirror 1023 rotatable around a first and second axis, such as a first axis 1500 and a second orthogonal axis 1502, as shown in FIG. 15 for the case of first mirror 1023 of first optical element 1002. As seen in FIG. 15, mirror 1023 may be rotated around first axis 1500, analogous to axis 1400 of FIG. 14, and second axis 1502, which second axis 1502 is perpendicular to first axis 1500 and lies in the plane defined by mirror 1023. This structure allows the optical axis parallel to the length of weapon 108 to be adjusted by way of moving folding mirror 1023.

The material of which prisms 1020 and 1022 are formed may cause some dispersion of light therethrough. The dispersion is due to the fact that the critical angle associated with total internal reflection is a function of wavelength; the longer the wavelength, the larger the critical angle. In the case that each one of optical elements 1002 and 1004 comprises only a single prism such as respective prisms 1020 and 1022, dispersion of light may occur at the demarcation arcs because the total internal reflection is not confined to occurring at one definite plane, but rather at slightly overlapping planes, each corresponding to slightly different wavelength. This dispersion is generally at the blue color wavelength and creates a blue streak in the FOV.

The blue streak may not irritate a user. However, the blue streak may be eliminated by the formation of each one of optical elements 1002 and 1004 from more than one prism, the multiple prisms having different optical dispersion characteristics i.e. achromatization, as is well known in the art.

Figure 16:
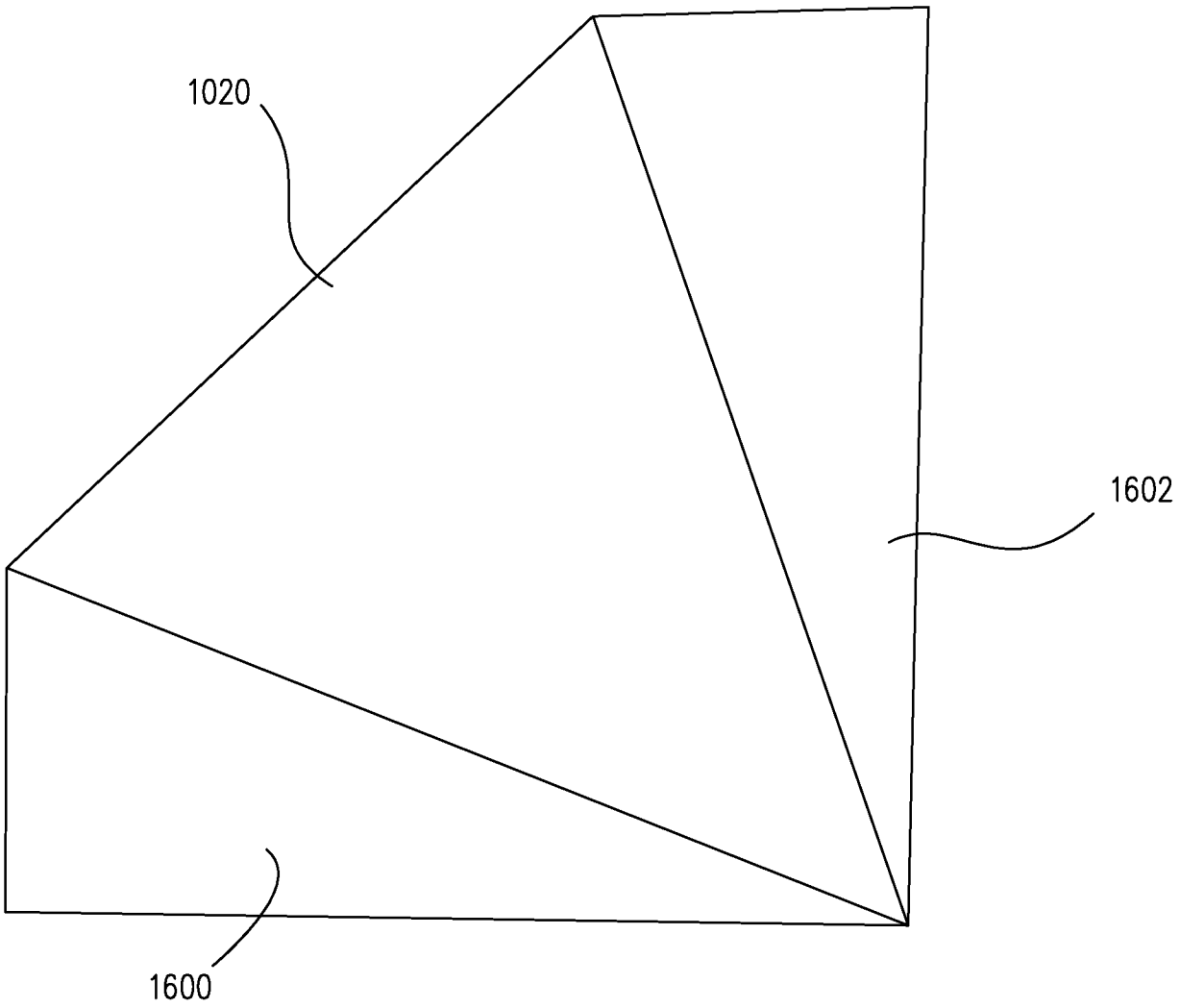
FIG. 16 is a simplified side view illustration of a portion of an optical element of an optical aiming device, constructed and operative in accordance with a still further preferred embodiment of the present invention.

FIG. 16 illustrates such an arrangement for the case of prism 1020. As seen in FIG. 16, an additional two wedge prisms 1600 and 1602 may be provided abutting prism 1020 on either side thereof. Prism 1020 may be formed of BK7 glass and wedge prisms 1600 and 1602 may be formed of SF4 glass. BK7 and SF4 glasses have compensating optical dispersion characteristics, thus substantially reducing the visibility of the blue streak.

The structure presented in FIG. 16 may alternatively be used for altering the color of demarcation arcs 1304 and 1310 of FIG. 13C, rather than for purposes of achromatization. In this application, parameters of prisms 1020, 1600 and 1602 may be selected so as to alter the color of the demarcation arcs, for example to produce generally red demarcation arcs having width of approximately 0.0005-0.002 radians. Such colored demarcations arcs may be advantageous due to the contrast formed between the colored demarcation arcs and the background, allowing the demarcation arcs to be more easily distinguished by a user and improving the visibility thereof. The exact color of the demarcation arcs will depend on the parameters of prisms 1020, 1600 and 1602 as well as the structure of multi-layer optical reflective coatings 300 formed thereon. By way of example, prism 1020 may be formed of BK7 glass with a sharp angle of approximately 77.50 and prisms 1600 and 1602 be formed of SF57 glass with sharp angles of approximately 29.1°.

Figure 17:
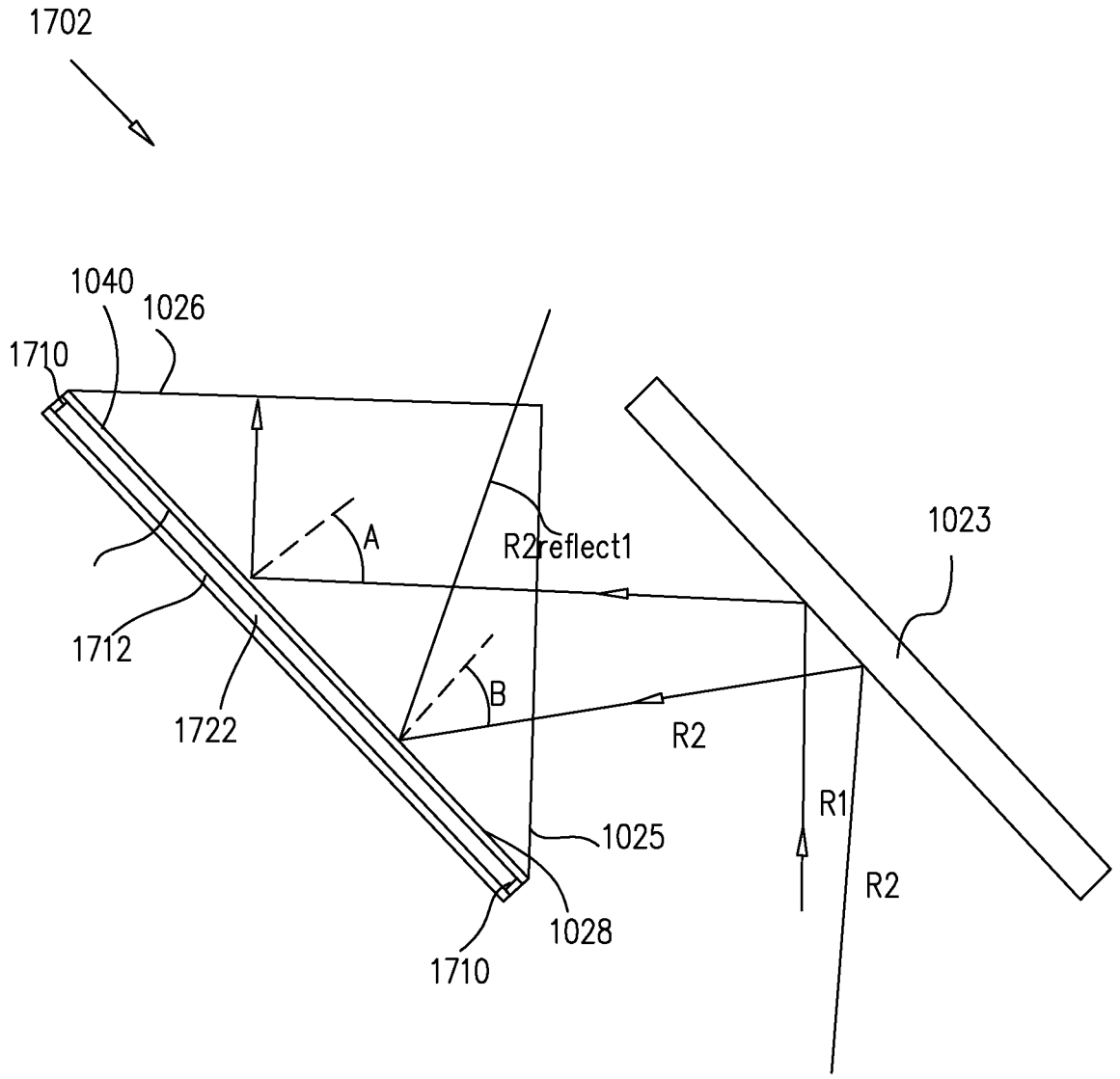
FIG. 17 is a simplified side view illustration of an optical element of an optical device, constructed and operative in accordance with another preferred embodiment of the present invention.

Each one of optical elements 1002 and 1004 may additionally include other optical structures, as seen, by way of example, in the case of an optical element 1702 illustrated in FIG. 17. Optical element 1702 is an alternative possible embodiment of optical element 1002, for incorporation in a further preferred embodiment of an optical aiming device of the present invention. It will be readily understood by one skilled in the art that modifications substantially the same as those made with respect to optical element 1002 so as to form optical element 1702 may be made to optical element 1004 to as to form a corresponding additional identically modified optical element sharing the same properties as those described herein below with respect to optical element 1702.

An optical aiming device constructed and operative in accordance with a preferred embodiment of the present invention may include two optical elements corresponding to modified optical element 1702, the two optical elements being mutually located as described above with reference to FIG. 10 and optical elements 1002 and 1004 illustrated therein.

As seen in FIG. 17, optical element 1702 may resemble optical element 1002 in every relevant respect, with the exception of optical element 1702 including an additional spacer layer 1710 formed atop of multilayer optical interference coating 1040 and a further additional mirror 1712 formed atop of each spacer layer 1710. Spacer layer 1710 and mirror 1712 are preferably formed atop of multilayer optical interference coating 1040 atop of total internal reflection facet 1028. Mirror 1712 is preferably mounted parallel to multilayer optical interference coating 1040. Spacer layer 1710 and mirror 1712 preferably have a length substantially equal to a length of first and second reflective facet 1028, as seen in FIG. 17.

A first typical ray of light R1 may impinge on first reflective facet 1028 having multi-layer optical coating 1040 thereon, at an angle equal to or greater than the critical angle A, for example at an angle equal to the critical angle A. R1 undergoes total internal reflection at first reflective facet 1028 and therefore does not pass into an empty space 1722 behind coating 1040, which empty space 1722 is preferably formed by spacers 1710. At angles equal to or greater than the critical angle A, optical element 1702 therefore remains completely transparent to impinging light, as is the case for optical element 1002 described above with reference to FIGS. 10 and 11.

A second typical ray of light R2 may impinge on first reflective facet 1028 and multilayer optical coating 1040 thereon at an angle B, less than but close to the critical angle A. R2 will be partially reflected at first reflective facet 1028, as depicted by a reflected portion $R2_{reflect1}$, and will be partially refracted into empty space 1722. The subsequent passage of the refracted portion $R2_{refract}$ of R2 following the entry thereof into empty space 1722 depends on the angle of refraction C of $R2_{refract}$ (not shown).

If the angle of refraction C of refracted ray $R2_{refract}$ satisfies:

$$\text{arctg}(L/2H)<C<90° \quad (6)$$

then $R2_{refract}$ will pass into empty space 1722, will be subsequently reflected by mirror 712, will be trapped in empty space 1722 and will finally be absorbed by spacers 1710. In formula (3), L corresponds to a length of empty space 1722 and H corresponds to a width of empty space 1722.

If the angle of refraction C of refracted ray $R2_{refract}$ satisfies:

$$C<\text{arctg}(L/2H) \quad (7)$$

then $R2_{refract}$ will pass into empty space 1722, will subsequently be reflected by mirror 1712 and will return into prism 1020 as a reflected ray, parallel to and offset from $R2_{reflect1}$.

As will be appreciated from the foregoing description of the interaction of rays R1 and R2 with reflective facet 1028 of optical element 1702, almost all of the rays impinging on reflective facet 1028 will be reflected from reflective facet 1028 and only rays having a narrow refractive angle falling within the range specified by formula (6) will be trapped within empty space 1722.

As a result of almost all of the light impinging on optical element 1702 being totally reflected in a direction towards user 110 and only a small portion thereof being refracted away from user 110, transmittance is high in the entire FOV seen by user 110, with the exception of in a narrow band having an angular width corresponding to the range of angles circumscribed by formula (6). Referring additionally to FIG. 18A, the transparent or clear region in the FOV is designated by a numeral 1800 and the band of lower transmittance is designated by a numeral 1802. As will be appreciated from a comparison of FIG. 18A to FIG. 13A, a shape of band 1802 is similar to a shape of demarcation arc 1304.

Transmittance T in band 1802 may be calculated in accordance with the formula $$T=(R_p+R_s)*0.5 \quad (8)$$

wherein $R_p$ and $R_s$ are the reflection coefficients of the multilayer optical interference coating 1040 on facet 1028 in the angular range defined by formula (6), for the S and P components of light.

Figure 18B:
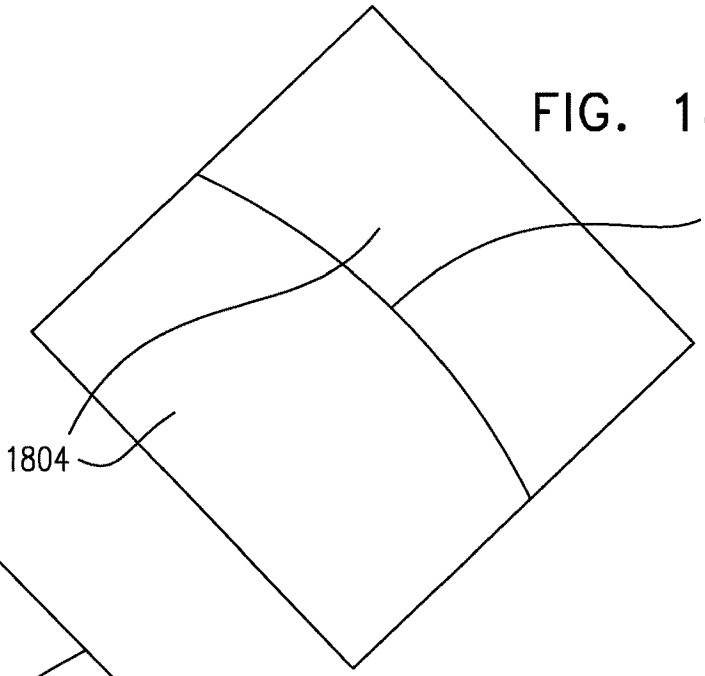
FIGS. 18A, 18B and 18C are simplified respective illustrations of a first view through a first optical element of an optical aiming device of the type illustrated in FIG. 17, of a second view through a second optical element thereof and of a third view through both first and second optical elements thereof.

It will be readily understood by one skilled in the art that just as clear region 1800 and opaque band 1802 are formed in the FOV of user 110 as a result of light reflected through first optical element 1702, so too a clear region 1804 and an opaque band 1806 as shown in FIG. 18B are formed in the field of view of user 110 as a result of light reflected through a second optical element resembling first optical element 1702 but being angled with respect thereto, in the manner of that described above with respect to the mutual arrangement of first and second optical elements 1002 and 1004 of FIG. 10.

As appreciated from a comparison of FIGS. 18A and 18B, opaque band 1802 is angled with respect to opaque band 1806, as a result of the plane perpendicular to the first reflective facet 1028 of optical element 1702 being angled with respect to the plane perpendicular to the reflective facet of a second optical element, corresponding to optical element 1702.

Figure 18C:
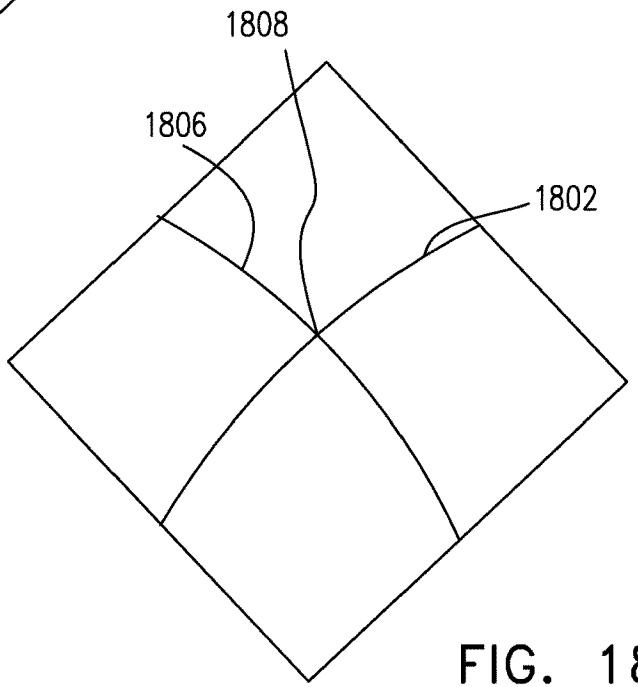
Figure 18A:
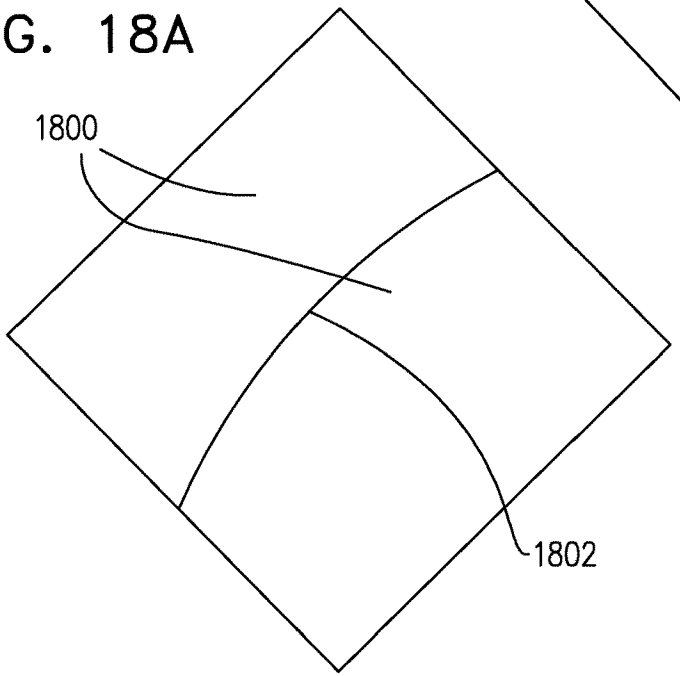

The combined FOV perceived by user 110 when viewing the target through first optical element 1702 and the second optical element corresponding thereto is illustrated in FIG. 18C. Opaque bands 1802 and 1806 intersect at a common point 1808. Since both bands 1802 and 1806 are aligned with the bull's eye 432 of the target 112, the point of intersection 1808 of the bands lies substantially along aiming axis 106 pointing to the bull's eye 432 of the target 112.

As appreciated from consideration of FIG. 18C, almost the entire FOV is clear, with the exception of in narrow bands 1802 and 1806 where transmittance is considerably less. This is a particularly advantageous feature of this embodiment of the present invention, since it allows user 110 to easily sight the target 112 at almost any point in the FOV.

As will be appreciated from a comparison of the FOV shown in FIGS. 18A-18C to the FOV shown in FIGS. 9A-9C, an optical aiming device including two optical elements of the type shown in FIG. 17 may provide as similar FOV as an optical aiming device including two optical elements of the type shown in FIG. 7. However, an optical aiming device of the type shown in FIG. 17 has the advantage of being more light-weight than optical aiming of the type shown in FIG. 7, due to the lighter weight of triangular prisms 1020 and 1022 in comparison to the weight of prism-parallelograms 120 and 122, for the same sized entry facet.

Furthermore, the optical aiming device of FIG. 17 may be held in a compact position when not in use by rotating of folding mirrors 1023 and 1024 and may be configured to allow adjustment of the optical axis of the weapon with which it is associated, in a similar fashion to that described above with reference to the optical aiming device illustrated in FIGS. 14 and 15.

Figure 19A:
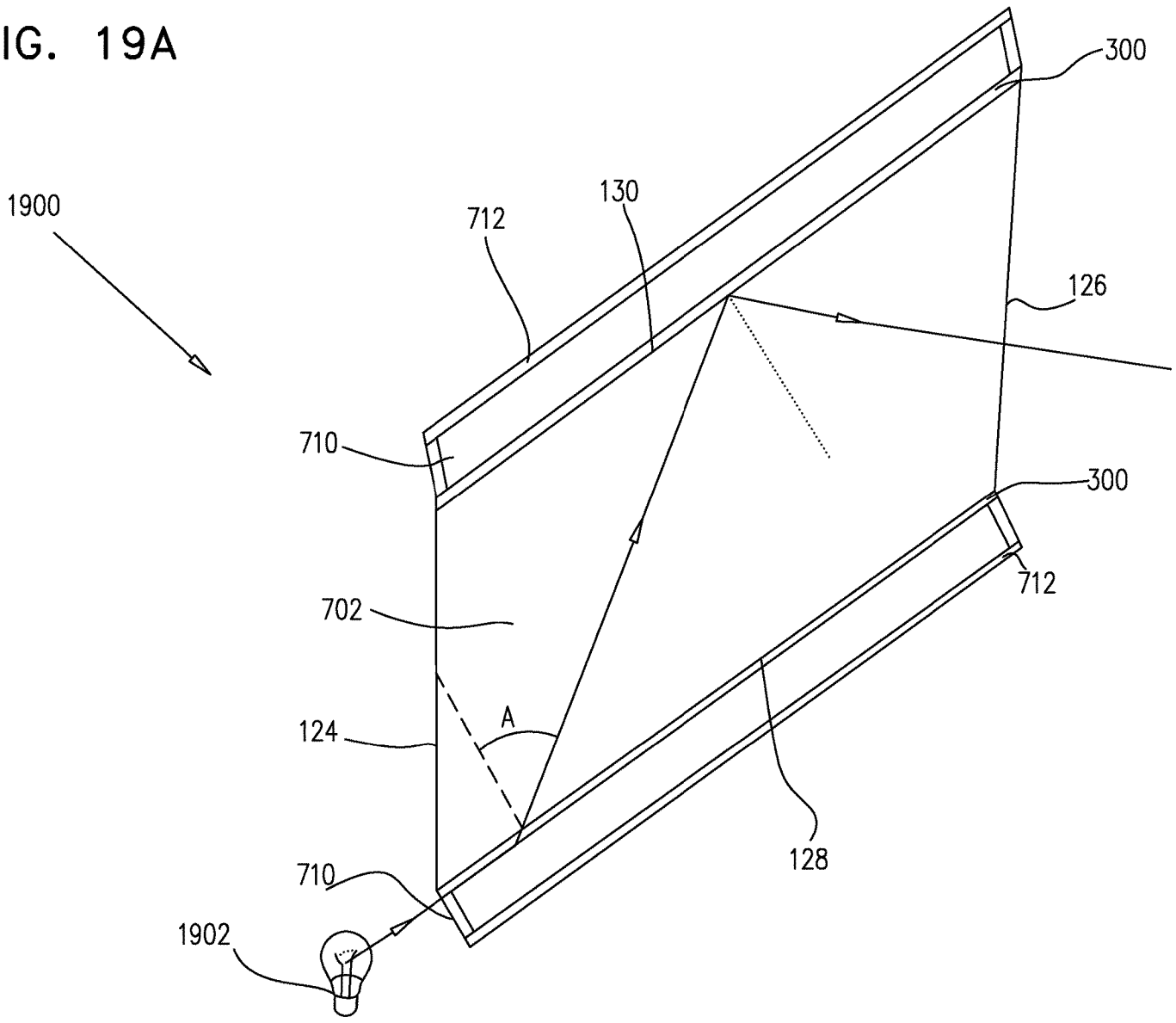
FIGS. 19A and 19B are simplified respective side and enlarged frontal view illustrations of an optical element of an optical aiming device constructed and operative in accordance with a still further preferred embodiment of the present invention.
Figure 19B:
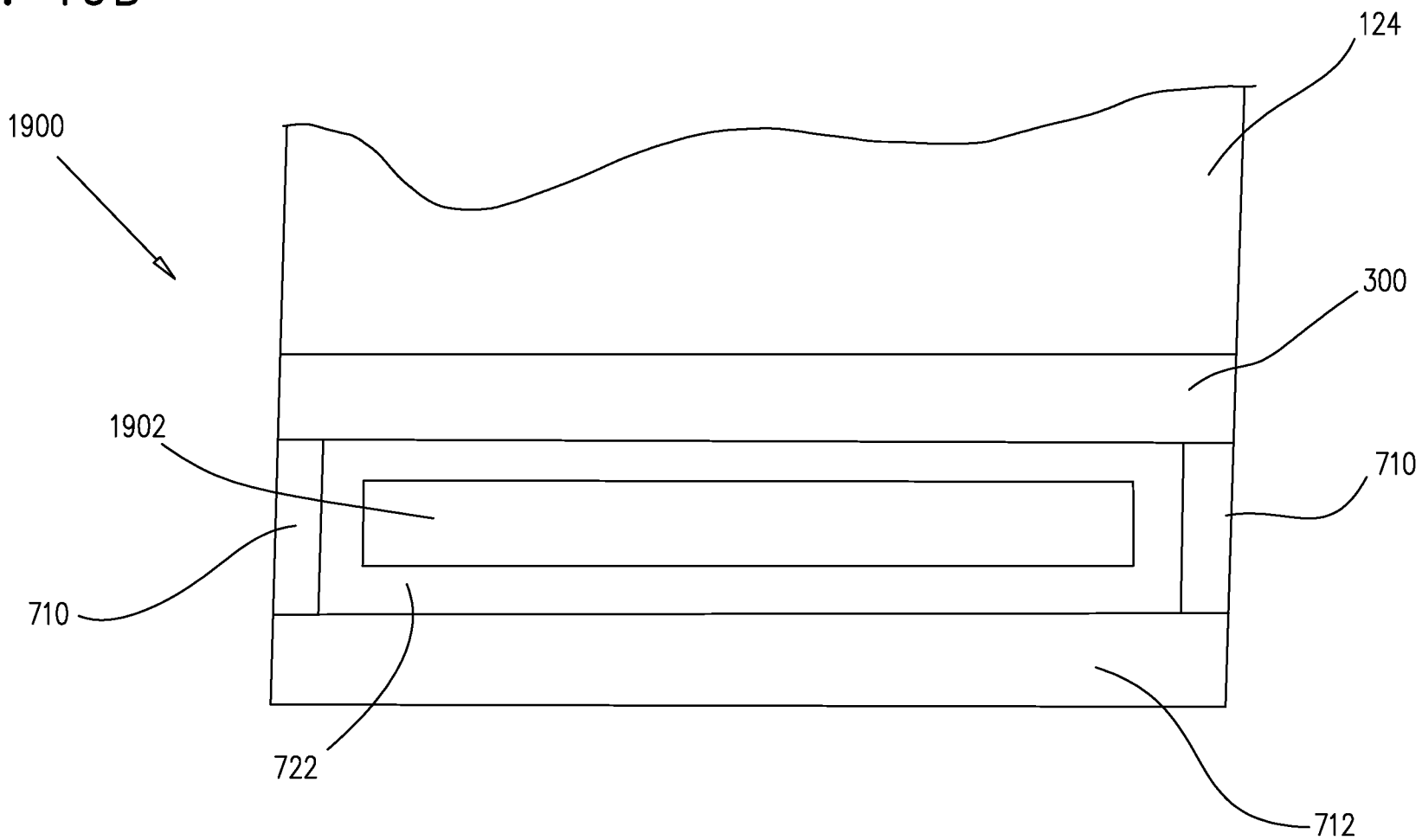

Reference is now made to FIGS. 19A and 19B, which are simplified respective side and frontal view illustrations of an optical element of an optical aiming device constructed and operative in accordance with a still further preferred embodiment of the present invention.

As seen in FIG. 19A, there is provided an optical assembly 1900 including optical element 702 of the type shown in FIG. 7, preferably comprising first prism parallelogram 120 having first reflective facet 128 and second reflective facet 130, multilayer optical interference coatings 300 being formed thereon. Spacer layer 710 and mirror 712 are disposed atop of each one of first and second reflective facets 128 and 130.

Optical assembly 1900 further preferably includes a generally linear narrow angle light source 1902, the location of which is best understood from consideration of FIG. 19B. FIG. 19B is an angled frontal view of optical assembly 1900, taken from the front of entry facet 124 of optical element 702 along a longitudinal axis of spacer layer 710. As seen in FIG. 19B, linear light source 1902 is preferably located close to entry facet 124 and generally parallel thereto. A center of linear light source 1902 preferably substantially coincides with a center of a cross-section of empty space 722. A direction of a light beam R (FIG. 19A) emitted by light source 1902 is preferably almost parallel to an optical axis of optical element 702 and preferably impinges on multilayer optical interference coating 300 at an angle of incidence very close to 90°. Light beam R therefore refracts inside prism-parallelogram 120 at an angle very close to the critical angle A and leaves optical element 702 at a location very close to that of narrow band 902.

As will be readily understood by one skilled in the art, an optical aiming device may include two optical elements of the type shown in FIGS. 19A and 19B, which two optical elements are preferably positioned with respect to each other in the manner described above with reference to the mutual locations of first and second optical elements 102 and 104 shown in FIGS. 1 and 2. Just as light beam R gives rise to a narrow light band almost coinciding with narrow band 902, due to the passage of light beam R through optical element 702, so too light beam R gives rise to an additional narrow light band almost coinciding with narrow band 906, due to the passage of light beam R through the additional optical element corresponding to optical element 702 but angled with respect thereto.

The inclusion of a light source, such as linear light source 1902, in a preferred embodiment of the optical aiming device of the present invention thus may be useful for enhancing the visibility of narrow bands 902 and 906. This may be particularly advantageous when the optical aiming device of the present invention is used in dark conditions. It is appreciated that although the inclusion of a light source is illustrated and described herein with respect to the embodiment of the optical aiming device shown in FIGS. 7 and 19A and 19B, a light source may be similarly combined with any of the other embodiments of the optical aiming device of the present invention described herein, so as to achieve similar enhanced visibility of the bands or demarcation arcs in the user's FOV. It is further appreciated that the light source 1902 illustrated in FIGS. 19A and 19B is representative only and that a variety of light sources may be suitable for inclusion in the present invention. Furthermore, it is appreciated that representation of the light source in FIG. 19B is schematic and highly simplified.

Figure 20:
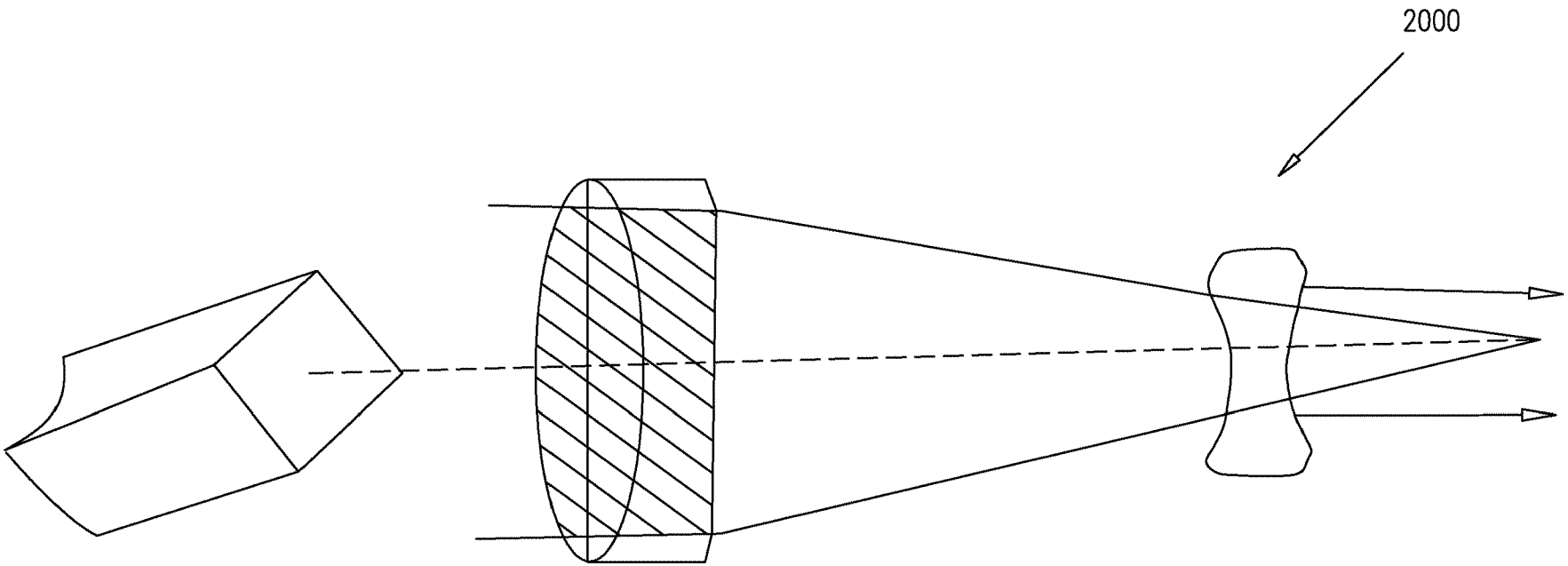
FIG. 20 is a simplified schematic illustration of an optical aiming device constructed and operative in accordance with another preferred embodiment of the present invention.

Embodiments of the optical aiming device of the present invention may additionally or alternatively be combined with a removable optical magnification system, which optical magnification system may be installed at the exit of the optical aiming device. The optical axis of the optical aiming device and the optical axis of the optical magnification system are preferably positioned so as to coincide. Such an optical magnification system may provide optical magnification when installed and may be removed when optical magnification is not required. Any suitable optical magnification system may be employed, such as, by way of example only, a Galileo Optical Tube 2000, as seen in FIG. 20. The presence of such an optical magnification system would not be expected to affect the aiming accuracy of the weapon with which the optical aiming device is associated.

A removable optical magnification system, such as that illustrated in FIG. 20, may be useful in refining the aiming of a weapon on which an optical aiming device of the present invention may be mounted. Initially, the removable optical magnification system may be absent and the user may sight through the optical aiming device and aim the weapon at the target in a preliminary manner. Identification of the target in the absence of the removable optical magnification system may be easier than in the case when the optical magnification system is present, since the FOV in the absence of the optical magnification system is wider.

Following such preliminary alignment of the weapon with the target, the user may then insert the optical magnification system so as to facilitate fine-tuning of the aiming of the weapon at the target. The employment of an optical magnification system with the optical aiming device of the present invention is possible due to the high angle resolution of the optical aiming device.

Figure 21:
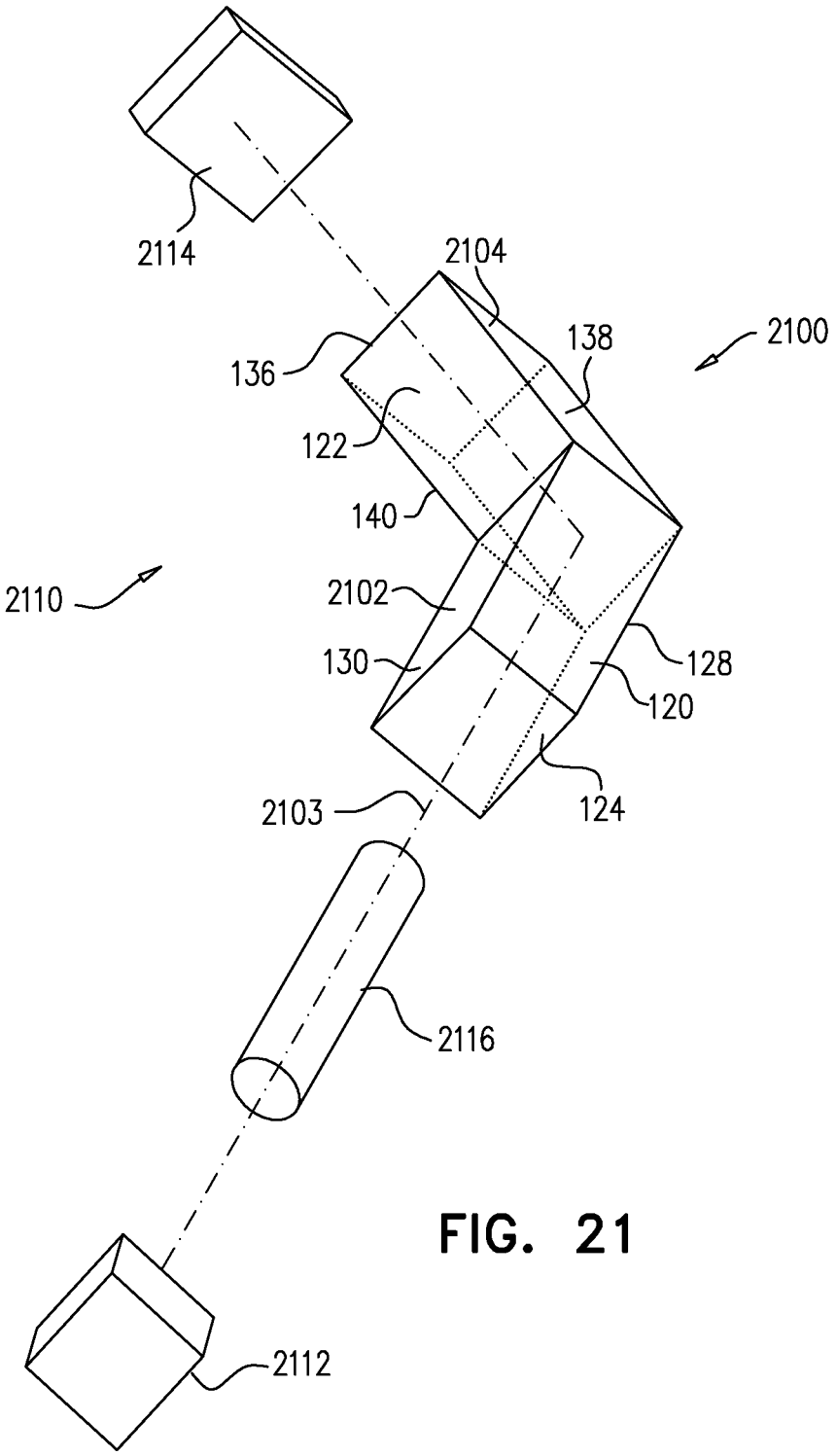
FIG. 21 is a simplified schematic view illustration of a laser system including an optical aiming device constructed and operative in accordance with yet another preferred embodiment of the present invention.

Reference is now made to FIG. 21, which is a simplified schematic view illustration of a laser system including an optical aiming device constructed and operative in accordance with yet another preferred embodiment of the present invention.

As seen in FIG. 21, there is provided an optical device 2100 for aiming light, also termed an optical aiming device 2100, preferably including a first optical element 2102 lying on an axis 2103 and a second optical element 2104 juxtaposed to the first optical element 2102 and angled with respect thereto. As will be appreciated from consideration of FIG. 21, optical aiming device 2100 and first and second optical elements 2102 and 2104 thereof preferably respectively generally resemble optical aiming device 100 and first and second optical elements 102 and 104 in all relevant aspects thereof, with the exception of the structure of the optical coatings of optical aiming device 2100, not shown in FIG. 21, as will be detailed henceforth with reference to FIGS. 22A-24. First optical element 2102 thus preferably comprises first prism 120 having entry facet 124 and second optical element 2104 thus comprises second prism 122 having exit facet 136.

Optical aiming device 2100 is preferably installed in a laser system 2110, preferably within an optical resonator thereof formed by a first resonator mirror 2112 and a second resonator mirror 2114 spaced apart therefrom. Preferably, optical aiming device 2100 is installed between first and second resonator mirrors 2112 and 2114, such that first resonator mirror 2112, second resonator mirror 2114 and entrance and exit facets 124, 136 are mutually parallel. Laser system 2110 further preferably includes an active laser medium 2116, which active laser medium 2116 may comprise a crystal, semiconductor, or tube holding a gaseous mixture, as shown here by way of example. Laser system 2110 preferably operates as a typical laser system in a manner well known in the art, in which an excitation source (not shown) provides light to optically excite active laser medium 2116, which light enters active laser medium 2116 by way of first resonator mirror 2112. Active laser medium 2116 preferably amplifies the incoming light and converts the light to coherent light, which coherent light leaves laser cavity 2110 via second resonator mirror 2114.

In the absence of optical aiming device 2100, laser system 2110 would typically output a primary beam of coherent light, termed the main output mode of laser system 2110, in addition to other secondary beams of coherent light at slightly different frequencies to the frequency of the primary beam. These secondary beams of coherent light may be termed additional output modes of laser 2110 and typically emerge in directions offset from the direction of the main output mode, thereby degrading the directionality and coherence of the laser output.

The inclusion of optical aiming device 2100 in laser system 2110 preferably serves to advantageously suppress all output modes besides for a main selected output mode, by optical aiming device 2100 transmitting light only over a very narrow angular range, as will be detailed henceforth. This suppression of additional modes causes alignment of the beam produced by laser system 2100, since substantially only a single mode emerges in a single direction.

As detailed earlier with respect to first and second optical elements 102 and 104 of device 100, first and second optical elements 2102 and 2104 of optical aiming device 2100 are preferably oriented such that perpendiculars to the first and second reflective facets 128, 130 of first prism 120 are angled with respect to perpendiculars to the third and fourth reflective facets 138, 140 of second prism 122. In such reciprocally angled disposition, first and second optical elements 2102 and 2104 preferably provide mode suppression in two different directions. Particularly preferably, the two directions of suppression are mutually perpendicular.

Figure 22A:
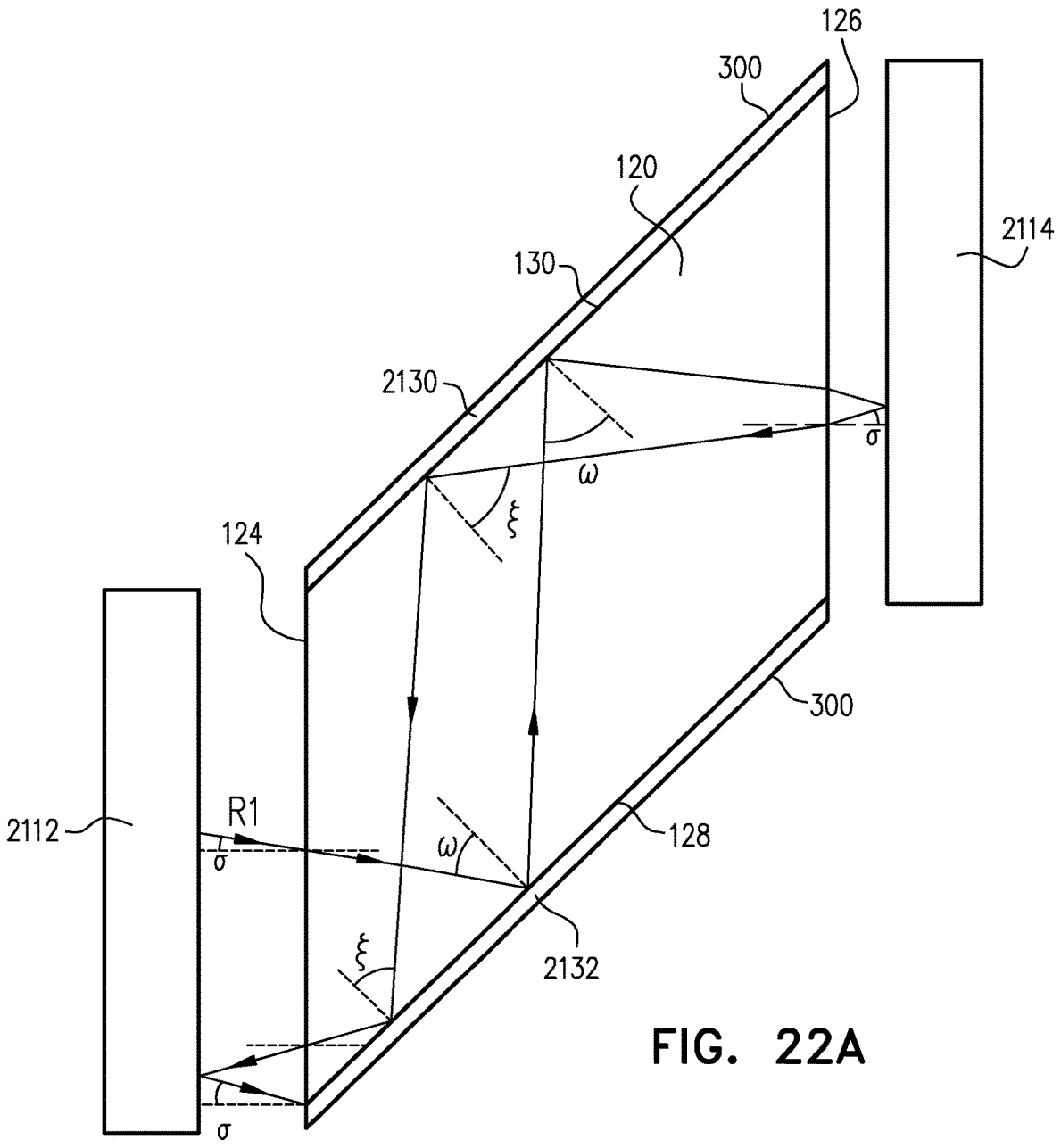
FIGS. 22A and 22B are simplified side view illustrations of an optical element of an optical aiming device of the type shown in FIG. 21, depicting light travelling therethrough.
Figure 22B:
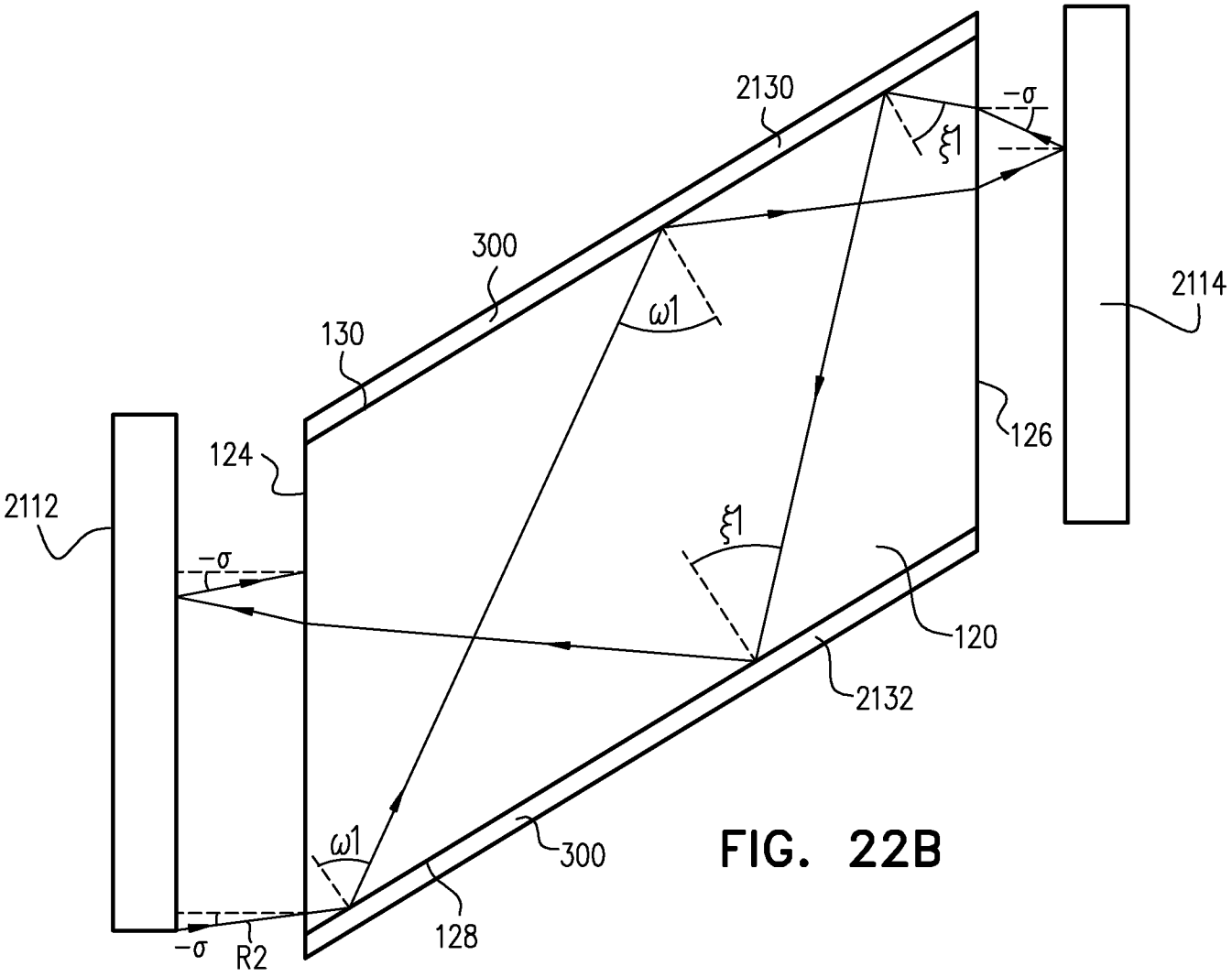
Figure 23:
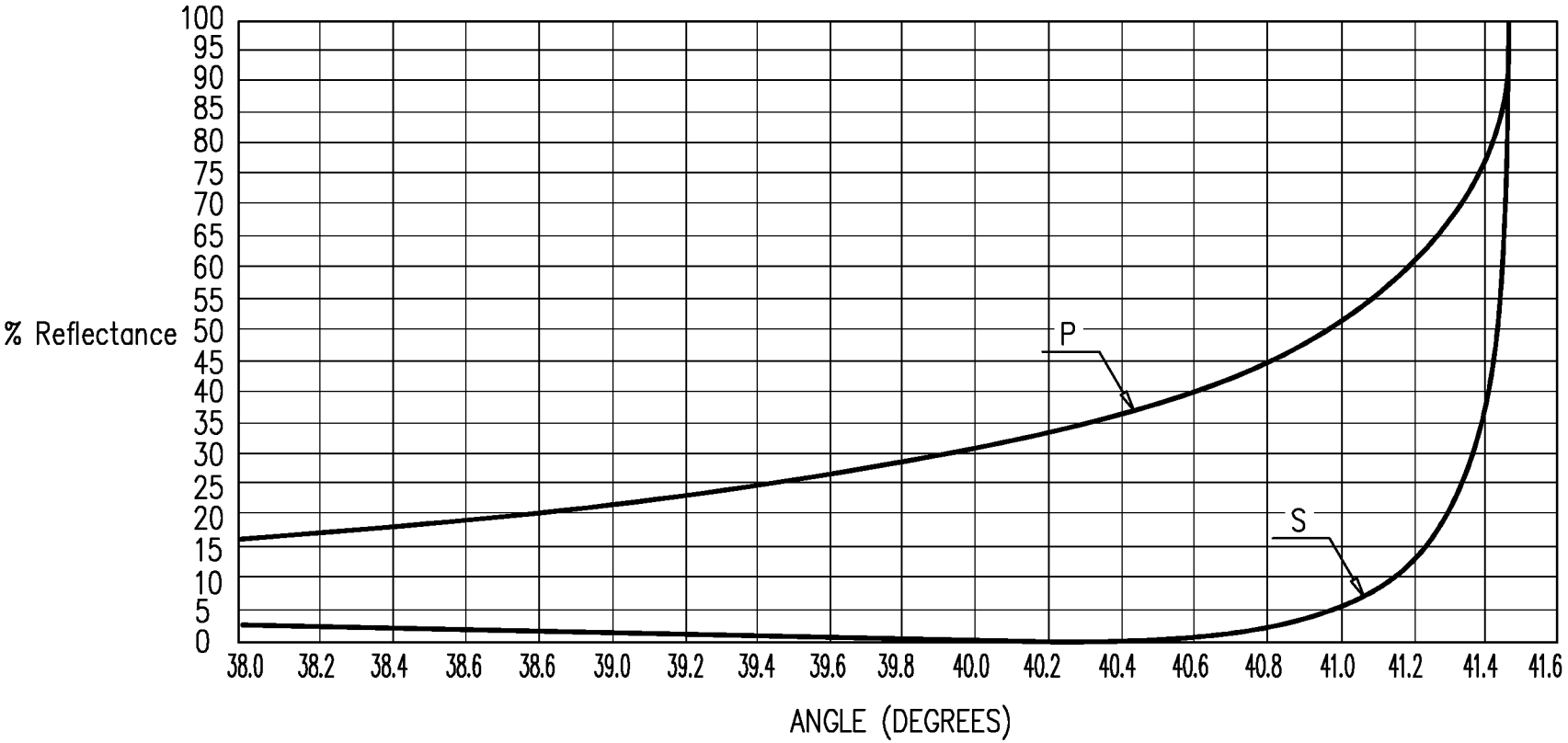
FIGS. 23 and 24 are simplified first and second graphs of S and P component reflection coefficients of light reflected from an optical aiming device of the type illustrated in FIG. 21.
Figure 24:
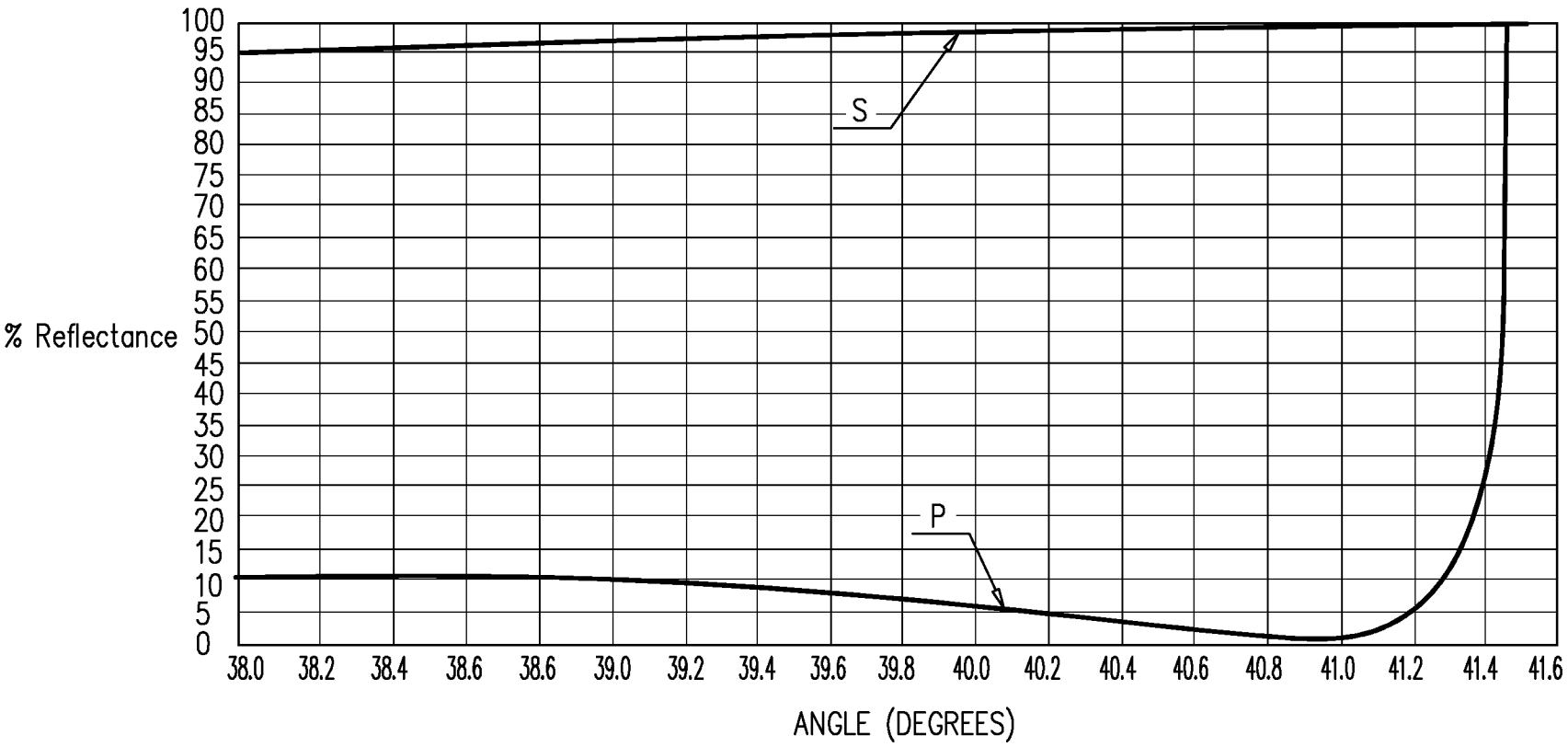

The propagation of light through optical aiming device 2100, resulting in mode suppression and laser beam alignment of laser system 2100, may be best understood with reference to FIGS. 22A and 22B.

It is appreciated that for the sake of simplicity and clarity of presentation, only one prism-parallelogram, such as prism 120 of optical element 2102, is depicted in FIGS. 22A and 22B. It is understood, however, that the explanation provided hereinbelow also applies to the second prism 122 of optical element 2104.

As seen in FIGS. 22A and 22B, prism 120 of optical element 2102 is shown in a side-view, disposed interfacing first and second resonator mirrors 2112 and 2114. For the sake of simplicity, active laser medium 2116 is omitted from FIGS. 22A and 22B.

Prism 120 preferably has a corner angle or sharp angle $\beta$. It will be shown below that if the sharp angle $\beta$ of prism 120 corresponds to the formula $$\beta=\varphi_{cr}+\arcsin((\sin\Delta)/n) \tag{9}$$

where $\varphi_{cr}$ is the critical angle of the glass comprising prism 120 having refractive index n, all of the rays impinging on entry facet 124 of prism 120 at an angle of entry $\sigma$ and $|\sigma|>\Delta$, will be suppressed by first optical element 104. Additionally, all of the rays impinging on entry facet 124 of prism 120 at an angle of entry $\sigma$ and $|\sigma|\leq\Delta$, will pass through optical element 102 and leave prism 120 via first exit facet 126. Optical element 104 is thus operative to suppress light entering therein at angles of entry greater than $\Delta$, where $\Delta$ depends on the properties of active laser medium 2116, when the sharp angle $\beta$ of the prism 120 is selected in accordance with formula (9).

Turning now to FIG. 22A, a first typical ray of light R1 emerging from active laser medium 2116 enters first prism 120 via first entry facet 124 at an angle of entry $\sigma>0$. R1 impinges on first total internal reflection plane 128 at an angle of incidence $\omega$, defined by the formula:

$$\omega=\varphi_{cr}+\arcsin((\sin\Delta)/n)-\arcsin((\sin\sigma)/n) \tag{10}$$

As appreciated from consideration of formula (10), in the case that $\sigma\leq\Delta$ then $\omega>\varphi_{cr}$ and R1 will therefore undergo total internal reflection at first internal reflection plane 128. Following the reflection of R1 from first internal reflection plane 128, R1 is incident on second total internal reflection plane 130 at an angle of incidence $\omega$ and correspondingly undergoes total internal reflection thereat. The ray reflected from total internal reflection plane 130 will then leave prism 120 via exit facet 126 and be incident on second resonator mirror 2114 at an angle of $\sigma$. This ray will then be reflected from second resonator mirror 2114 and enter prism 120 via first exit facet 126 with an angle of entry $\sigma$.

Following entry into prism 120 via exit facet 126 at angle of entry $\sigma$, R1 then successively impinges on second internal reflection plane 130 and first internal reflection plane 128 at an angle $\xi$, where $\xi$ defined by the formula:

$$\xi=\varphi_{cr}+\arcsin((\sin\Delta)/n)+\arcsin((\sin\sigma)/n) \tag{11}$$

As appreciated from consideration of formula (11), $\xi$ must be greater than $\varphi_{cr}$, such that R1 will undergo total internal reflection at both second and first total internal reflection planes 130, 128 and leave prism 120 via first entry facet 124. Since the angle of refraction of R1 is $\sigma$, R1 will be reflected by first resonator mirror 2112 and enter first entry facet 124 of prism 120 at an angle of entry equal to $\sigma$. R1 will therefore continue to circulate inside laser system 2110, thereby undergoing laser amplification.

Returning to formula (10), it is appreciated that if R1 enters prism 120 with an angle of entry $\sigma>\Delta$, then $\omega<\varphi_{cr}$. In this case, R1 will be partially reflected and partially refracted by first total internal reflection surface 128, the refracted part of R1 subsequently passing through the first internal reflection plane 128 and leaving prism 120 (not shown). When R1 enters prism 120 with an angle of entry $\sigma>\Delta$ only a small portion of R1 thus continues to propagate through prism 120 and R1 is hence suppressed.

Reference is now made to the FIG. 22B which is simplified side view illustration of prism 120 of optical element 2102, depicting light impinging thereon in the case that the angle of entry is negative.

As seen in FIG. 22B, a second typical ray of light R2 emerging from active laser medium 2116 enters first prism 120 via first entry facet 124 at a negative angle of entry $\sigma<0$ or $-\sigma$ and impinges on first total internal reflection plane 128 at an angle of incidence $\omega_1$, defined by the formula:

$$\omega_1=\beta+\arcsin(\sigma/n)=\varphi_{cr}+\arcsin((\sin\Delta)/n)+\arcsin((\sin\sigma)/n) \quad (12)$$

As appreciated from consideration of formula (12), $\omega_1$ must be greater than $\varphi_{cr}$ and R2 will therefore undergo total internal reflection at first internal reflection plane 128. R2 reflected from first internal reflection plane 128 will then be incident on second total internal reflection plane 130 at an angle of incidence $\omega_1$ and correspondingly undergo total internal reflection thereat. The ray reflected from total internal reflection plane 130 will leave prism 120 via exit facet 126 and be incident on second resonator mirror 2114 at an angle of $-\sigma$. This ray will then be reflected from second resonator mirror 2114 and enter prism 120 via first exit facet 126 with an angle of entry $-\sigma$.

Following entry into prism 120 via exit facet 126 at angle of entry $-\sigma$, R2 then successively impinges on second internal reflection plane 130 and first internal reflection plane 128 at an angle $\xi_1$, where $\xi_1$ defined by the formula:

$$\xi_1=\varphi_{cr}+\arcsin((\sin\Delta)/n)-\arcsin((\sin\sigma)/n) \quad (13)$$

As appreciated from consideration of formula (13), in the case that $\sigma>\Delta$ then $\xi_1<\varphi_{cr}$ and the main part of R2 will pass through second total internal reflection plane 130 and leave prism 120, such that R2 is suppressed.

However, in the case that $\sigma\leq\Delta$ then $\xi_1>\varphi_{cr}$ such that R2 will undergo total internal reflection at both first and second total internal reflection planes 128, 130 and leave prism 120 via first entry facet 124. Since the angle of refraction of R1 is $-\sigma$, R1 will be reflected by first resonator mirror 2112 and enter first entry facet 124 of prism 120 at an angle of entry equal to $-\sigma$. R2 will therefore continue to circulate inside laser system 2110, thereby undergoing laser amplification.

It is understood from the foregoing description of the passage of light through prism 120 of optical element 2102, that all of the rays of light entering entry facet 124 of prism 120 at angle of entry $\sigma$ and $|\sigma|>\Delta$ will be suppressed by optical element 102. Furthermore, all of the rays of light entering entry facet 124 of prism 120 at an angle of entry $\sigma$ and $|\sigma|\leq\Delta$ will travel through optical element 102 with negligible losses and leave prism 120 via first exit facet 126, thereby leading to reflection and subsequent laser amplification of the light.

The foregoing applies to rays having planes of incidence parallel to the plane shown in FIGS. 22A and 22B as well as to rays having planes of incidence lying perpendicular to the plane of FIGS. 22A and 22B. As will be readily appreciated by one skilled in the art, rays having other angular planes of incidence may be represented as the vector sum of rays having parallel and perpendicular planes of incidence.

It has been found particularly effective, in this embodiment of the present invention, to provide mutually different multi-layer optical interference coatings 300 on the first internal reflection plane 128 and second internal reflection plane 130 of the first optical element 102 and similarly to provide mutually different multi-layer optical interference coatings on the second optical element on the internal reflection planes 138 and 140. One optical coating, such as a first multi-layer optical interference coating 2130 may primarily suppress the S component of light and another coating, such as a second, different multi-layer optical interference coating 2132 may primarily suppress the P component of light.

A multi-layer optical interference coating suitable for use in this embodiment of the present invention may comprise alternating layers of Hafnium Dioxide ($HfO_2$) and Silicon Dioxide ($SiO_2$), preferably formed on a glass substrate with a refractive index of n=1.5. Possible parameters of such coatings are presented in the two tables below, each of which tables lists the layer number, material of which the layer is formed and physical layer thickness in nanometers, for each layer of a preferred embodiment of a multi-layer optical interference coating of the present invention.

In the first table below are presented data for a first coating for primarily suppressing the S component of light, such as coating 2130. In the second table below are presented data for a second, different coating for primarily suppressing the P component of light, such as coating 2132. Spectral characteristics for each of these coating are respectively presented in FIG. 23 and FIG. 24, for light having a wavelength $\lambda$=630 nm.

| Layer No. | Layer Material | Layer thickness (nm) |
|---|---|---|
| Air | | |
| 1 | $SiO_2$ | 138 |
| 2 | $HfO_2$ | 95 |
| 3 | $SiO_2$ | 143 |
| 4 | $HfO_2$ | 276 |
| 5 | $SiO_2$ | 286 |
| 6 | $HfO_2$ | 48 |
| Glass | | |
| n = 1.51 | | |
| Air | | |
| 1 | $HfO_2$ | 83 |
| 2 | $SiO_2$ | 151 |
| 3 | $HfO_2$ | 94 |
| 4 | $SiO_2$ | 155 |
| 5 | $HfO_2$ | 92 |
| 6 | $SiO_2$ | 474 |
| 7 | $HfO_2$ | 282 |
| 8 | $SiO_2$ | 162 |
| 9 | $HfO_2$ | 284 |
| Glass | | |
| n = 1.51 | | |

It is appreciated that the above tabulated structures of multilayer optical interference coatings suitable for incorporation in a preferred embodiment of the optical aiming device of the present invention are exemplary only and that other multilayer optical interference coatings may alternatively be used, as are well known in the art. These may include coatings comprising different materials, a different numbers of layers and/or layers of different thicknesses in comparison to those listed herein.

Figure 25:
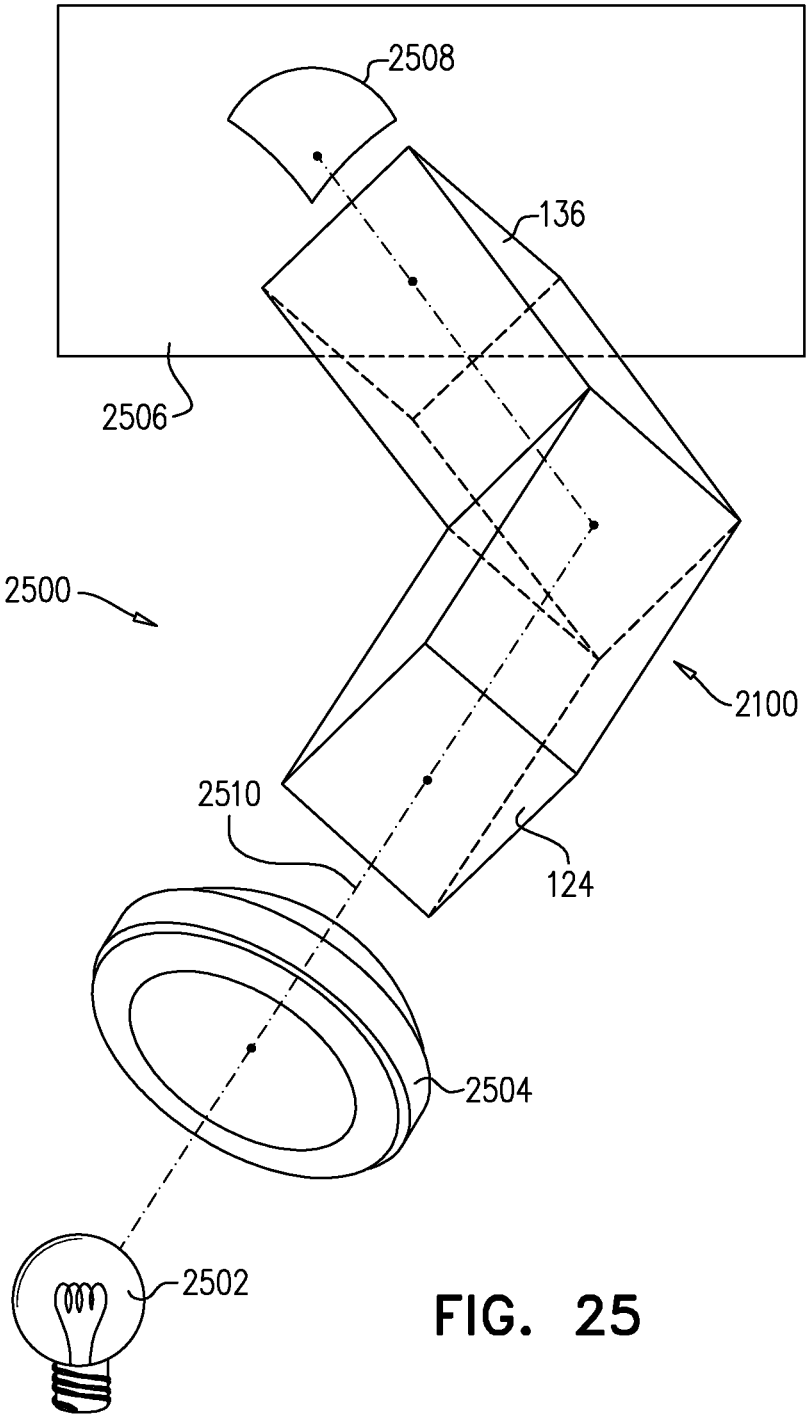
FIG. 25 is a simplified schematic view illustration of a cosmetology device including an optical aiming device of the type shown in FIG. 21.

Optical aiming device 2100 may also be particularly well suited for use in optical cosmetology applications, as illustrated in FIG. 25 showing a simplified schematic illustration of an optical cosmetology device 2500.

As seen in FIG. 25, cosmetology device 2500 preferably includes a light source 2502, a focusing system 2504 for focusing light received from light source 2502 and optical aiming device 2100 for receiving light from focusing system 2504 and forming a spot of focused light on a body of a patient to be treated, here generally indicated by a reference numeral 2506. Light irradiated by light source 2502 is preferably concentrated by focusing system 2504 on entrance surface 124 of optical aiming device 2100. Optical aiming device 2100 preferably produces a light output at exit surface 136, which light output is preferably in the form of a spot and is projected onto the patient 2506 in the form of a spot 2508 having a required shape. An exemplary passage of light through cosmetology device 2500 is generally indicated by a representative axis 2510.

It is appreciated that optical aiming device 2100 thus preferably operates in cosmetology device 2500 as a spot formation system. Optical aiming device 2100 is particularly well-suited for this application, due to the capability thereof of providing a spot having abrupt boundaries and at any chosen distance between exit surface 136 and the surface of the patient body 2506. This allows light spot 2508 having the required shape suitable for treatment to be formed on any desired surface of the patient's body 2506, the shape and size of light spot 2508 being substantially independent of the distance between exit surface 136 of device 2100 and the treatment surface of patient 2506.

In operation of cosmetology device 2500, a user such as a doctor may adjust spot 2508 so as to be aimed at a given position on patient body 2506 using low energy light. Following spot 2508 being satisfactorily positioned on patient body 2506, the energy of light provided by light source 2502 may be increased, so as to be of an energy suitable for treatment.

Figure 26:
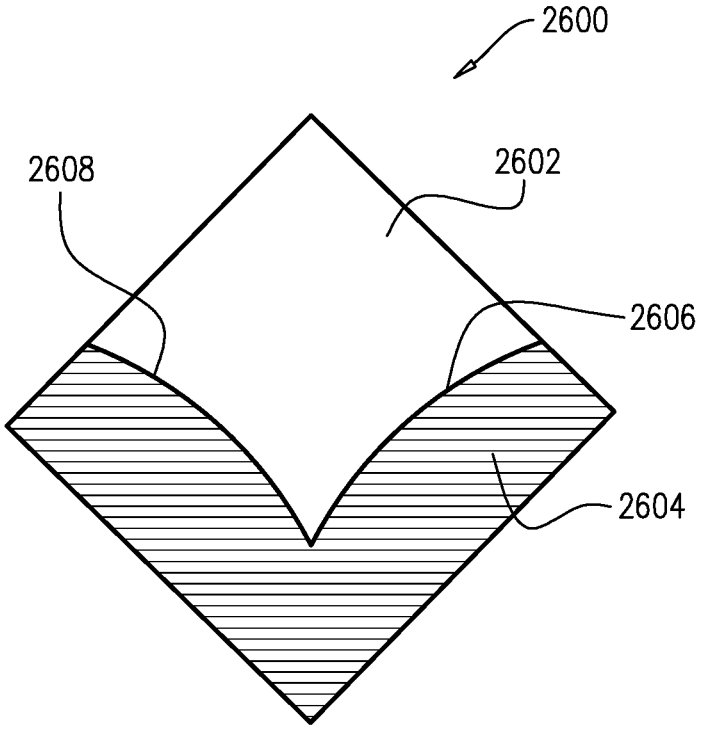
FIG. 26 is a simplified schematic view illustration of a view through the optical aiming device of FIG. 25.

A field of view through optical aiming device 2100 when incorporated in cosmetology device 2500 is presented in FIG. 26. As seen in FIG. 26, a field of view 2600 comprises a quadrate structure including a fully transparent region 2602 and an opaque, minimally transparent region 2604. Edges of fully transparent region 2602 are preferably delineated by first and second boundaries 2606 and 2608. Boundaries 2606 and 2608 may be very abrupt and particularly may have an abruptness of less than 0.0002 radians.

It is appreciated that the field of view through optical aiming device 2100 shown in FIG. 26 essentially corresponds to the light output of optical aiming device 2100. Fully transparent region 2602 thus is an illuminated region corresponding to spot 2508 having extremely abrupt boundaries 2606 and 2608 confining light spot 2508 from two sides.

As will be appreciated from a comparison of the field of view of optical aiming device 2100 shown in FIG. 26 with the field of view of optical aiming device 100 shown in FIG. 4C, the two fields of view have generally similar configurations. However, opaque region 2504 of optical aiming device 2100 is less transparent than corresponding opaque regions 422, 424, 426 of optical aiming device 100. This decrease in transparency of optical aiming device 2100 in comparison to optical aiming device 100 is due to the use of mutually different optical interference coatings 300 in optical aiming device 2100, rather than the use of the same optical interference coatings 300 as in optical aiming device 100. The use of different optical interference coatings 300 in optical aiming device 2100 leads to increased suppression of light, making optical aiming device 2100 particularly useful for applications in which light outside of fully transparent region 2602 requires greater suppression.

Figure 27:
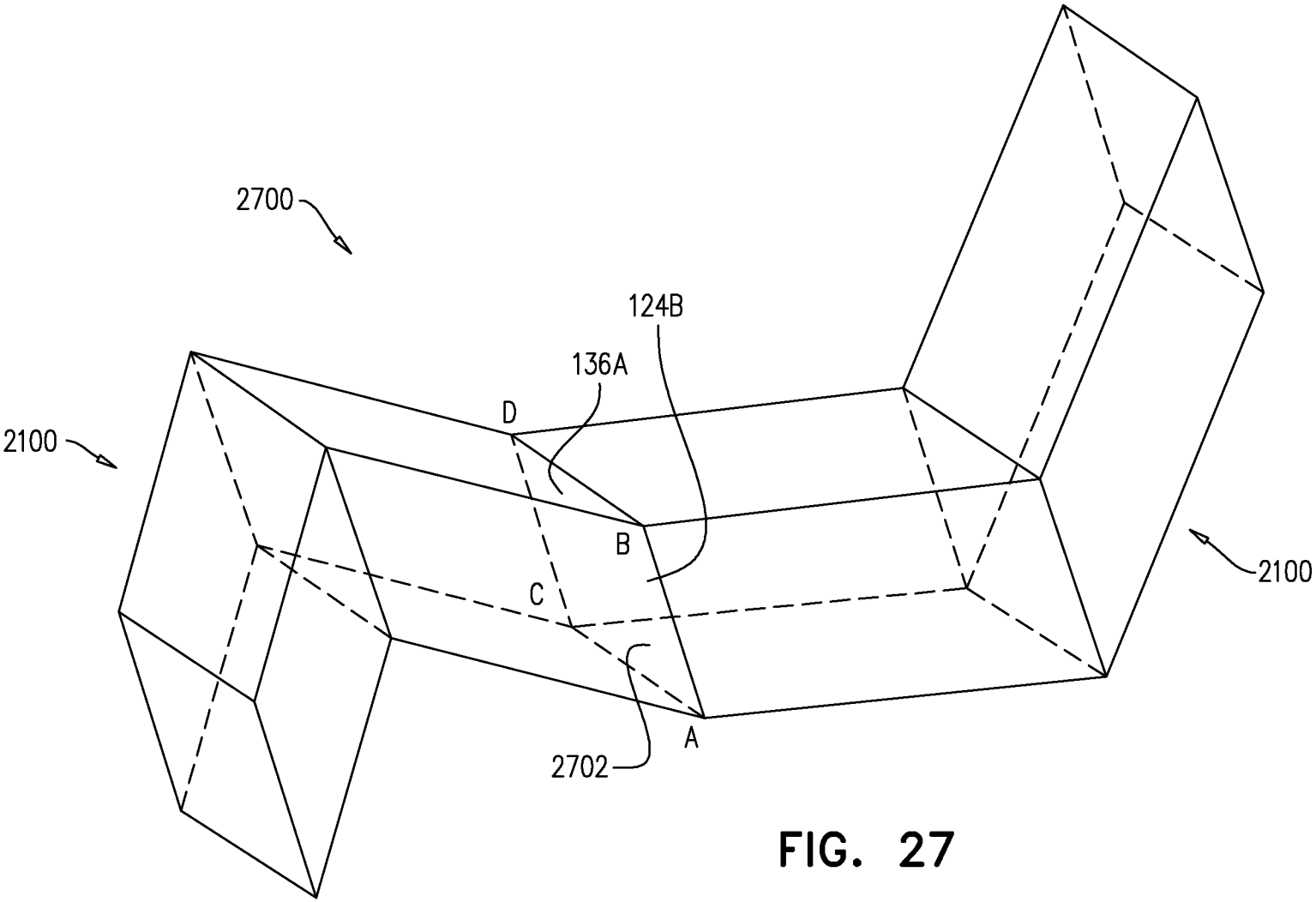
FIG. 27 is a simplified schematic view illustration of an optical aiming device constructed and operative in accordance with a still further preferred embodiment of the present invention.

It is appreciated that two optical aiming devices of the present invention may be co-aligned in order to produce a combined, modified field of view therethrough. As illustrated in FIG. 27, two optical aiming devices of the present invention may be co-aligned so as to form a composite optical aiming device 2700. Here, by way of example, two optical aiming devices 2100 are shown to be co-aligned although it is appreciated that other optical aiming devices of the present invention, such as two of optical aiming devices 100, may alternatively be co-aligned.

As seen in FIG. 27, exit facet 136A of one of optical aiming devices 2100 may be disposed abutting entry facet 124B of adjacent optical aiming device 2100 defining a common plane 2702 having corners ABCD. Edge AB of plane 2702 and edge AC of plane 2702 are preferably mutually angled, preferably at an angle of 90°+/−15°.

Figure 28:
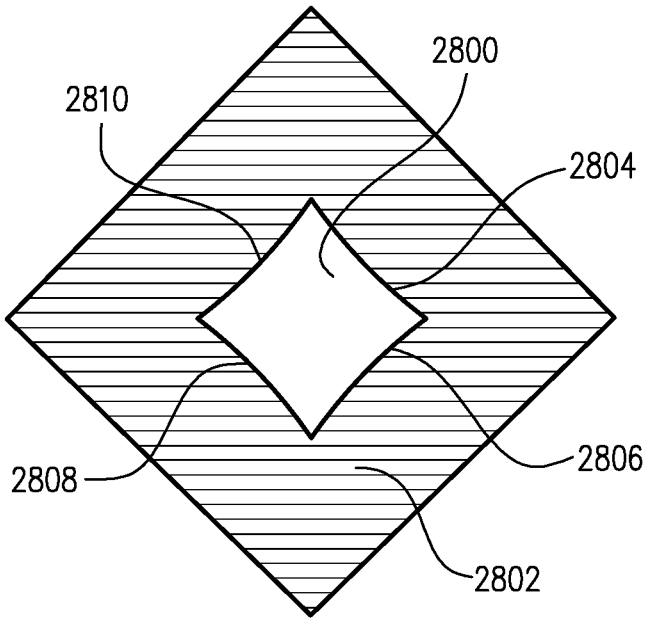
FIG. 28 is a simplified schematic view illustration of a view through the optical aiming device of FIG. 27.

The field of view through device 2700 is shown in FIG. 28. As appreciated from consideration of FIG. 28, the field of view through device 2700 is the superposition of each one of the fields of view of the two optical devices 2100 forming device 2700. The field of view includes a central fully transparent region 2800 bound by an opaque, minimally transparent region 2802. Transparent region 2800 is separated from opaque region 2802 by four common demarcation arcs, 2804, 2806, 2808 and 2810. It is appreciated that the shape and size of fully transparent region 2800 may be altered by rotation of the two optical devices 2100 with respect to each other about the axes AB and/or AC.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. An optical aiming device comprising:

a first multi-faceted optical element lying on an axis, said first multi-faceted optical element comprising a first prism; and a second multi-faceted optical element juxtaposed to said first multi-faceted optical element and angled with respect thereto, said second multi-faceted optical element comprising a second prism, said first and second optical elements each being characterized by a refractive index and a critical angle defining at least one total internal reflection plane formed by at least one facet of each one of said first and second optical elements, said at least one facet having an optical interference coating formed thereon, said first and second prisms being optically identical and positioned such that perpendiculars to said total internal reflection planes thereof are not mutually parallel, each one of said first and second optical elements causing light impinging on said at least one total internal reflection plane at an angle greater than or equal to said critical angle to be totally reflected and light impinging on said at least one total internal reflection plane at an angle less than said critical angle to be partially reflected and partially refracted, the totally reflected light illuminating a first region, the partially reflected light partially illuminating a second region, a demarcation being defined between said first and second regions, said first and second optical elements being oriented such that said demarcations of said first and second optical elements intersect at a point lying substantially along said axis.

2. An optical aiming device according to claim 1, wherein each one of said first and second optical elements comprises only a single said prism.

3. An optical aiming device according to claim 1, wherein each said prism comprises a prism-parallelogram comprising an entry facet for light entering said prism-parallelogram, an exit facet generally parallel to said entry facet for light exiting said prism-parallelogram and two mutually generally parallel facets respectively forming two said total internal reflections planes.

4. An optical aiming device according to claim 3, and also comprising first and second wedge prisms respectively juxtaposed to said entry and exit facets of said prism-parallelogram, said first and second wedge prisms having optical dispersion characteristics differing from an optical dispersion characteristic of said prism-parallelogram.

5. An optical aiming device according to claim 1, and also comprising a spacer layer formed on each said optical interference coating and a mirror formed on each said spacer layer, said spacer layer defining a space between said optical interference coating and said mirror.

6. An optical aiming device according to claim 1, wherein each said optical element comprises a triangular prism and each one of said first and second optical elements also comprises a mirror associated with each said triangular prism.

7. An optical aiming device according to claim 6, wherein each said triangular prism comprises an entry facet for light entering said triangular prism, an exit facet for light exiting said triangular prism and a facet forming one said total internal reflection plane.

8. An optical aiming device according to claim 7, and also comprising first and second wedge prisms respectively juxtaposed to said entry and exit facets of said triangular prism, said first and second wedge prisms having optical dispersion characteristics differing from an optical dispersion characteristic of said triangular prism.

9. An optical aiming device according to claim 8, and also comprising a spacer layer formed on each said optical interference coating and a mirror formed on each said spacer layer, said spacer layer defining a space between said optical interference coating and said mirror.

10. An optical aiming device according to claim 9, wherein said mirror is a folding mirror rotatable about one axis thereof, such that said folding mirror may be held in an extended position when said optical aiming device is in use and may be held in a folded position when said optical aiming device is not in use.

11. An optical aiming device according to claim 10, wherein said folding mirror has two mutually orthogonal axes of rotation.

12. An optical aiming device according to claim 1, and also comprising a generally linear narrow angle light source located in front of one of said optical elements.

13. An optical aiming device according to claim 1, and also comprising a removable optical magnification system.

14. An optical aiming system including two co-aligned abutting optical aiming devices of claim 1.

15. A laser system comprising:

an optical resonator;

an active laser medium located within said optical resonator for outputting optically amplified light; and an optical aiming device according to claim 1 for receiving said optically amplified light and suppressing a portion thereof.

16. A cosmetology device comprising:

a light source for outputting light;

a focusing system for receiving and focusing said light from said light source; and an optical aiming device according to claim 1 for receiving said light from said focusing system and forming a spot of said light.

17. A method for aiming a weapon at a target comprising:

providing two optical elements mounted on said weapon, each one of said two optical elements comprising a prism being characterized by a refractive index and a critical angle defining at least one total internal reflection plane thereof, one of said two optical elements lying on an aiming axis of said weapon; said prisms comprising said two optical elements being mutually optically identical and positioned such that perpendiculars to said total internal reflection planes thereof are not mutually parallel, each optical element causing light impinging on said at least one total internal reflection plane at an angle greater than or equal to said critical angle to be totally reflected and light impinging on said at least one total internal reflection plane at an angle less than said critical angle to be partially reflected and partially refracted, the totally reflected light illuminating a first region, the partially reflected light partially illuminating a second region, a demarcation being defined between said first and second regions, said optical elements being oriented such that said demarcations of said optical elements intersect at a point lying substantially along said aiming axis; and aligning said intersection point with said target.

18. A method for aiming a weapon at a target according to claim 17, wherein said partially refracted light is partially trapped by said optical element when said angle is less than but close to said critical angle.

19. A method for aiming a weapon at a target according to claim 17, and also comprising providing a linear narrow angle light source, said light source being located in front of one of said optical elements, a direction of light emitted by said light source being almost parallel to an optical axis of said one of said optical elements, a passage of said light emitted by said light source through said optical elements giving rise to narrow bands of light respectively almost coinciding with said demarcations, thus enhancing visibility of said demarcations.

* * * * *